US007628568B2

(12) United States Patent
Critsinelis

(10) Patent No.: US 7,628,568 B2
(45) Date of Patent: Dec. 8, 2009

(54) HINGE-OVER RISER ASSEMBLY

(75) Inventor: Antonio C. F. Critsinelis, Kingwood, TX (US)

(73) Assignee: Chevron U.S.A. Inc., San Ramon, CA (US)

( * ) Notice: Subject to any disclaimer, the term of this patent is extended or adjusted under 35 U.S.C. 154(b) by 244 days.

(21) Appl. No.: 11/668,050

(22) Filed: Jan. 29, 2007

(65) Prior Publication Data

US 2008/0179064 A1 Jul. 31, 2008

(51) Int. Cl.
*F16L 1/12* (2006.01)

(52) U.S. Cl. ..... 405/169; 405/173

(58) Field of Classification Search ..... 405/169, 405/172, 173, 158

See application file for complete search history.

(56) References Cited

U.S. PATENT DOCUMENTS 4,277,202 A * 7/1981 Archambaud et al. ..... 405/169
4,906,137 A 3/1990 Maloberti
5,320,175 A 6/1994 Ritter
6,854,930 B2 * 2/2005 Pionetti ..... 405/172

* cited by examiner

*Primary Examiner*—John Kreck
(74) *Attorney, Agent, or Firm*—Nicholas F. Gallo; Christopher D. Northcutt

(57) ABSTRACT

A method for installing a subsea flowline and riser assembly on a sea floor includes providing a flowline having an axis and an end connected to a hinge-over joint, and a riser having an axis and an end connected to the joint such that the axes of the riser and flowline extend substantially parallel. An end of the flowline opposite the joint is lowered to the sea floor. The end of the flowline connected to the joint is lowered to the sea floor. The joint is connected to a foundation that is installed in the sea floor. The riser is rotated about the hinge-over joint such that the riser axis is substantially perpendicular to the flowline axis. A subsea jumper is connected between an opening formed in the flowline and an opening formed in the riser so that the riser is in fluid communication with the flowline.

16 Claims, 21 Drawing Sheets

HINGE-OVER RISER ASSEMBLY

FIELD OF THE INVENTION

This invention relates in general to the conveyance of hydrocarbons from a subsea well or wells, and in particular to an apparatus and assembly, and methods associated therewith, for conveying the hydrocarbons from a subsea flowline to a floating production unit or vessel at the surface.

BACKGROUND OF THE INVENTION

When conveying hydrocarbons from a subsea well to a vessel at the surface, the hydrocarbons are often communicated through flowlines and risers extending along the surface of the sea floor. The flowline is the part resting on the sea floor and the riser is the piece that connects the flowline to the floating production unit or vessel at the surface. The flowline can be extending from a single subsea wellhead, from subsea processing equipment, or from a subsea collection manifold.

In one previous arrangement, a steel catenary riser (SCR) is an extension of the flowline or pipeline from the sea floor to a hang-off location in the floating production unit or vessel at the surface. Such an arrangement required very long risers such that the steel riser could rise gradually in a catenary shape from the sea floor to the surface of the sea.

In another previous arrangement, a vertical riser, typically also made of steel, extends from a subsea base toward the surface of the sea. The riser can extend to a surface vessel, or to a buoy that is located at, or just under the surface of the sea for connection with floating production unit or vessel at the surface. In one standard arrangement with a submerged buoy, the buoy is approximately fifty (50) meters below the sea surface such that a vessel does not damage the buoy if it travels over the buoy. In this arrangement, the submerged buoy provides an upward lift on the riser such that the riser extends substantially vertical relative to the sea floor. The subsea flowline or pipeline connects to the riser through a subsea jumper in order to communicate the hydrocarbons from the flowline or pipeline to the riser. Typically, because the flowline or pipeline is installed prior to the riser and riser base, the subsea jumper is fabricated pursuant to measurements taken on site. Such measurements, fabrication, and installation can be timely and labor intensive.

The floating production unit or vessel at the surface connects to the vertical riser via a flexible flowline jumper. The flexible flowline jumper communicates the hydrocarbons from the riser to the floating production unit or vessel. A mooring assembly helps to ensure that the floating production unit or vessel stays on location within predetermined distances relative to the buoy so that movement of the floating production unit or vessel due to tidal drift or wind does not damage the riser assembly.

Installation of the vertical riser assemblies followed the following steps. Initially, the flowline or pipeline is installed independently from the riser. The flowline or pipeline typically has a flowline end or a pipeline end termination (PLET) with a connector for jumper installation. The flowline or pipeline is typically installed using either an S-lay, J-lay, or Reel installation vessel. The riser base or foundation is then installed adjacent the flowline end or PLET. A typical riser base is a conventional foundation, such as a "suction pile" as is readily known to those skilled in the art, with interface for vertical riser connection at the top of the pile.

After the installation of the flowline or pipeline and the riser foundation is complete, the riser is installed separately. Typically, the riser is installed using a J-lay vessel that vertically deploys the riser and a riser latch onto the riser base. After the riser is installed and latched onto the riser base, the buoy is connected to the upper end of the riser to provide the upward support of the riser. After subsea measurement, the subsea jumper is then fabricated and installed in order to connect the flowline or pipeline with the riser in fluid communication.

The floating production unit or vessel then is transported and moored in the field. The flexible jumper is then installed between the FPSO and the riser, preferably with a riser interface positioned at an upper end portion of the riser. The operator then hydrotests and pre-commissions the riser assembly prior to actuating valves to allow the hydrocarbons to communicate through the flowline, the subsea jumper, the riser, and the flexible jumper, to the floating production unit or vessel at the surface.

Accordingly, in the prior vertical riser arrangement there were several distinct steps that were required for installation of the riser assembly: 1) install the flowline; 2) install the riser foundation; 3) install the riser assembly; 4) subsea measure, fabricate and install the subsea jumper between the flowline and the riser; 5) install or moor the floating production unit or vessel; 6) install the flexible surface jumper between the riser and the floating production unit or vessel; and 7) hydrotest and pre-commission the riser assembly.

SUMMARY OF THE INVENTION

The invention comprises a method to install flowline or pipelines and risers using the hinge-over joint device that links the flowline and pipeline with riser which allows the new proposed installation method to take place.

A method for installing a subsea flowline and riser assembly on a sea floor includes providing a flowline having a flowline axis and an end connected to a hinge-over joint, and a riser having a riser axis and an end connected to the hinge-over joint such that the axes of the riser and flowline extend substantially parallel to each other. An end of the flowline opposite from the hinge-over joint is lowered to the sea floor. The end of the flowline connected to the hinge-over joint is then also lowered to the sea floor. The hinge-over joint is connected to a foundation that is installed in the sea floor. The riser is rotated about the hinge-over joint such that the riser axis is substantially perpendicular to the flowline axis. A subsea jumper is connected between a flowline opening formed in the flowline and a riser opening formed in the riser so that the riser is in fluid communication with the flowline.

The step of rotating the riser about the hinge-over joint can also include moving an end of the riser opposite from the end connected to the hinge-over joint upward. The riser is rotated in such a manner so that the riser is substantially vertical relative to the sea floor.

In the step of providing the flowline, hinge-over joint, and the riser, the axes of the riser and flowline can extend substantially coaxially. The foundation can be installed prior to the step of lowering the end of the flowline opposite of the hinge-over joint to the sea floor, or after the step of lowering the end of the flowline connected to the hinge-over joint to the sea floor. The method can also include that a remote operated vehicle (ROV) can connect the subsea jumper between the riser opening and the flowline opening.

The step of providing the flowline, hinge-over joint, and riser can also include providing that the hinge-over joint has a movable arm and a joint base. The arm can be pivotally connected to the base and the riser can be connected to the arm. The method can also include locking the arm in a deployment position prior to step lowering the flowline to the sea floor so that the axes of the riser and flowline remain substantially parallel prior to step rotating the riser about the hinge-over joint. The rotating of the riser about the hinge-over joint can further include the step of unlocking the arm prior to rotating the riser about the hinge-over joint, and locking the arm in an operating position so that the axes of the riser and the flowline remain substantially perpendicular prior to connecting the subsea jumper.

A method for installing a subsea flowline and riser assembly on a sea floor includes lowering a first end of a flowline from a floating vessel to the sea floor. A hinge-over joint is then connected to a second end of the flowline. A first end of a riser is then connected to the hinge-over joint, and then the hinge-over joint and the first end of the riser are lowered to the sea floor from the vessel. The hinge-over joint aligns the flowline and the riser such that a flowline axis extending from the second end of the flowline is substantially in-line with a riser axis extending from the first end of the riser. The hinge-over joint is then connected to a foundation installed in the sea floor. A second end of the riser is then lifted in order to rotate the riser about the hinge-over joint, such that the riser axis extending from the first end of the riser traverses or intersects the flowline axis extending from the flowline. With an ROV, a subsea jumper is connected between a flowline opening formed adjacent the second end of the flowline and a riser opening formed adjacent the first end of the riser so that the riser is in fluid communication with the flowline.

The method can also include that the subsea jumper is fabricated prior to the step of lowering the first end of the flowline, pursuant to predetermined dimensions such that the subsea jumper can readily connect between the flowline opening and the riser opening after the riser is lifted to rotate the riser about the hinge-over joint.

In the method, the hinge-over joint can have a movable arm and a joint base, and the second end of the flowline can be connected to the base. The arm can be pivotally connected to the base and the first end of the riser can be connected to the arm. The method can also include locking the arm in a deployment position prior to lowering the hinge-over joint and the first end of the riser to the sea floor. When the riser is being lifted, the method can further include the steps of unlocking the arm prior to lifting the second end of the riser and thereby rotating the riser about the hinge-over joint, and locking the arm in an operating position with the riser axis extending from the first end of the riser traversing the flowline axis extending from the second end of the flowline prior to connecting the subsea jumper with the ROV. The method can also include that the riser axis extending from the first end of the riser is substantially perpendicular with the flowline axis extending from the second end of the flowline when the arm is locked in the operating position.

The method can also include that prior to connecting the hinge-over joint to the foundation, the second end of the riser is lowered to the sea floor, and then the foundation is installed. A further step can include unlocking the hinge-over joint and lifting the end of the riser opposite from the hinge-over joint away from the seafloor, thereby rotating the riser to its final substantially vertical position.

Alternatively, the foundation can be installed prior to lowering the first end of the flowline to the sea floor, and the hinge-over joint is lowered onto the foundation when the hinge-over joint is lowered to the sea floor.

An assembly for transferring hydrocarbons from a sea floor to a vessel at the surface includes a riser that extends substantially vertically relative to the sea floor and a flowline that extends substantially parallel to the sea floor. A hinge-over joint is connected to a foundation installed in the sea floor. The hinge-over joint has a base and a movable arm that is pivotally mounted to the base. The base is connected to an end of the flowline, and the arm is connected to the riser. Prior to the hinge-over joint being connected to the foundation, the arm is in an installation position in which a riser axis is substantially parallel to a flowline axis. After the hinge-over joint is connected to the foundation, the arm is in an operating position in which the riser axis is substantially perpendicular to the flowline axis. A riser opening is formed in the riser adjacent the connection between the riser and the arm, and a flowline opening is formed in the flowline adjacent the connection between the flowline and the base. A subsea jumper extends between the riser opening and the flowline opening so that the riser is in fluid communication with the flowline.

In the assembly, the subsea jumper can be prefabricated prior to the hinge-over joint being connected to the foundation such that the subsea jumper engages the riser opening and the flowline opening when the arm is in the operating position.

In the assembly, the hinge-over joint can have a locking mechanism that is adapted to be actuated by an ROV. The locking mechanism can engage the arm to lock the arm in the installation position prior to the hinge-over joint being connected to the foundation, and to lock the arm in the operating position after the hinge-over joint is connected to the foundation. The assembly can also include that the locking mechanism disengages from the arm when the arm moves from the installation position to the operating position.

In the assembly, an end portion of the flowline opposite from the connection with the base can be adapted to connect to a subsea structure that supplies hydrocarbons. An end portion of the riser opposite from the connection with the arm can be adapted to connect to a surface jumper extending from the vessel.

An assembly for transferring hydrocarbons from a sea floor to a vessel at the surface includes a subsea riser and a subsea flowline. A hinge-over joint is connected to a foundation installed in the sea floor. The hinge-over joint has a stationary member and a movable member mounted to the stationary member. The stationary member is connected to an end of the flowline and the movable member is connected to an end of the riser. The movable member is in an installation position in which a riser axis is substantially parallel to a flowline axis prior to the hinge-over joint being connected to the foundation. The movable member is in an operating position in which the riser axis is substantially perpendicular to the flowline axis after the hinge-over joint is connected to the foundation. A riser opening is formed in the riser adjacent the connection between the riser and the movable member. A flowline opening is formed in the flowline adjacent the connection between the flowline and the stationary member. A subsea jumper extends between the riser opening and the flowline opening with the riser being in fluid communication with the flowline.

DETAILED DESCRIPTION OF THE PREFERRED EMBODIMENT

Figure 1A:
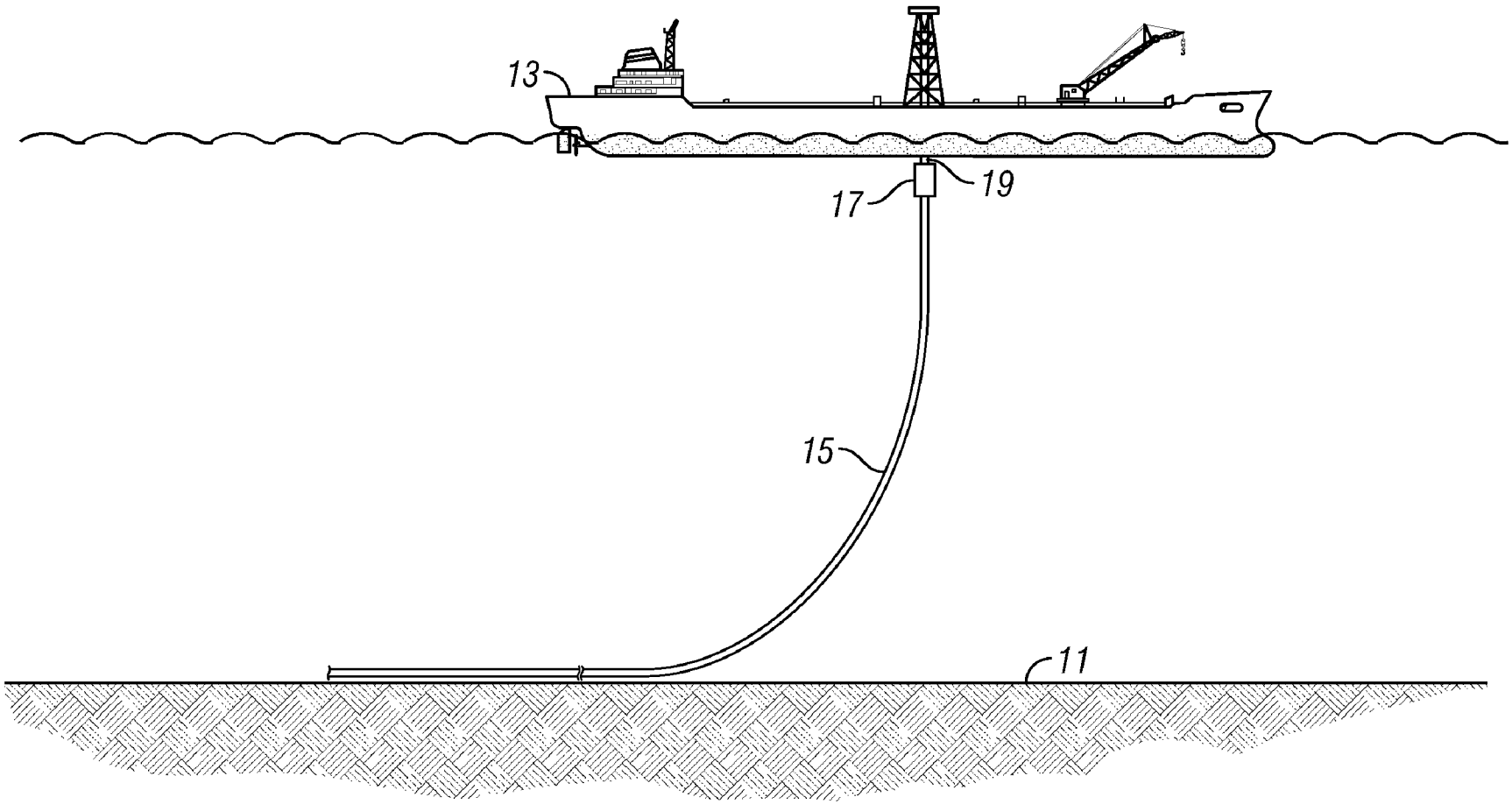
FIGS. 1A-1E are sequential, schematic views of a subsea flowline and riser assembly constructed and being installed in accordance with an embodiment of this invention.

Referring to FIGS. 1A-1E, a method is illustrated for installing a subsea flowline and riser assembly 10 (FIG. 1E) on a sea floor 11 according to one embodiment of the present invention. In the preferred embodiment, an installation vessel 13 sails to a predetermined location to begin the installation of subsea flowline and riser assembly 10. While vessel 13 is illustrated as a "J-Lay" vessel, vessel 13 can also be an "S-lay" vessel or a "REEL" vessel for the installation of subsea flowline and riser assembly 10 pursuant the various methods described herein.

Vessel 13 lowers a first end portion of a flowline 15 to sea floor 11. This can be in accordance with standard practices, in which a plurality of segments of flowline 15 are each welded to a previous segment which is about to be lowered into the sea in order to form a single flowline of a desired length. The flowline installation begins with a predetermined target area and ends in a predetermined target area. As will be readily appreciated by those skilled in the art, vessel 13 begins lowering the first end portion of flowline 15 a predetermined distance away from the final target area, and sails toward target area as additional flowline segments are added to flowline 15. After the final segment of flowline 15 is welded together, the second end portion of flowline 15 is connected, to a hinge-over joint 17 located on vessel 13.

Hinge-over joint 17 is then also prepared for being lowered to sea floor 11 from vessel 13. Prior to lowering hinge-over joint 17 into the sea, a first end, or first end portion of a riser 19 is connected to an opposite end of hinge-over joint 17 such that hinge-over joint 17 is positioned between flowline 15 and the first segment of riser 19. Preferably, the first end of riser 19 is connected to hinge-over joint 17 with a weld.

Figure 1B:
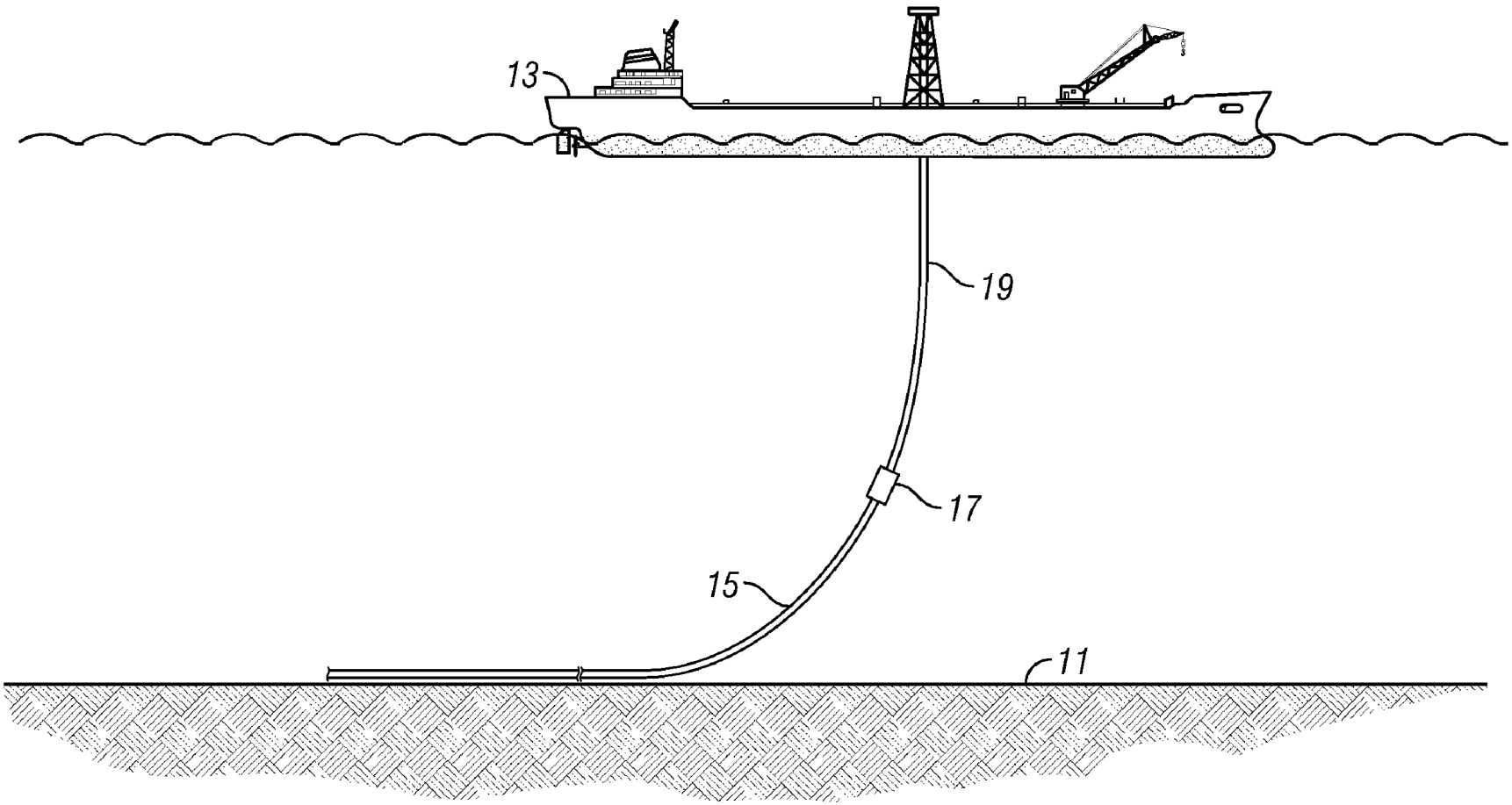
Figure 1C:
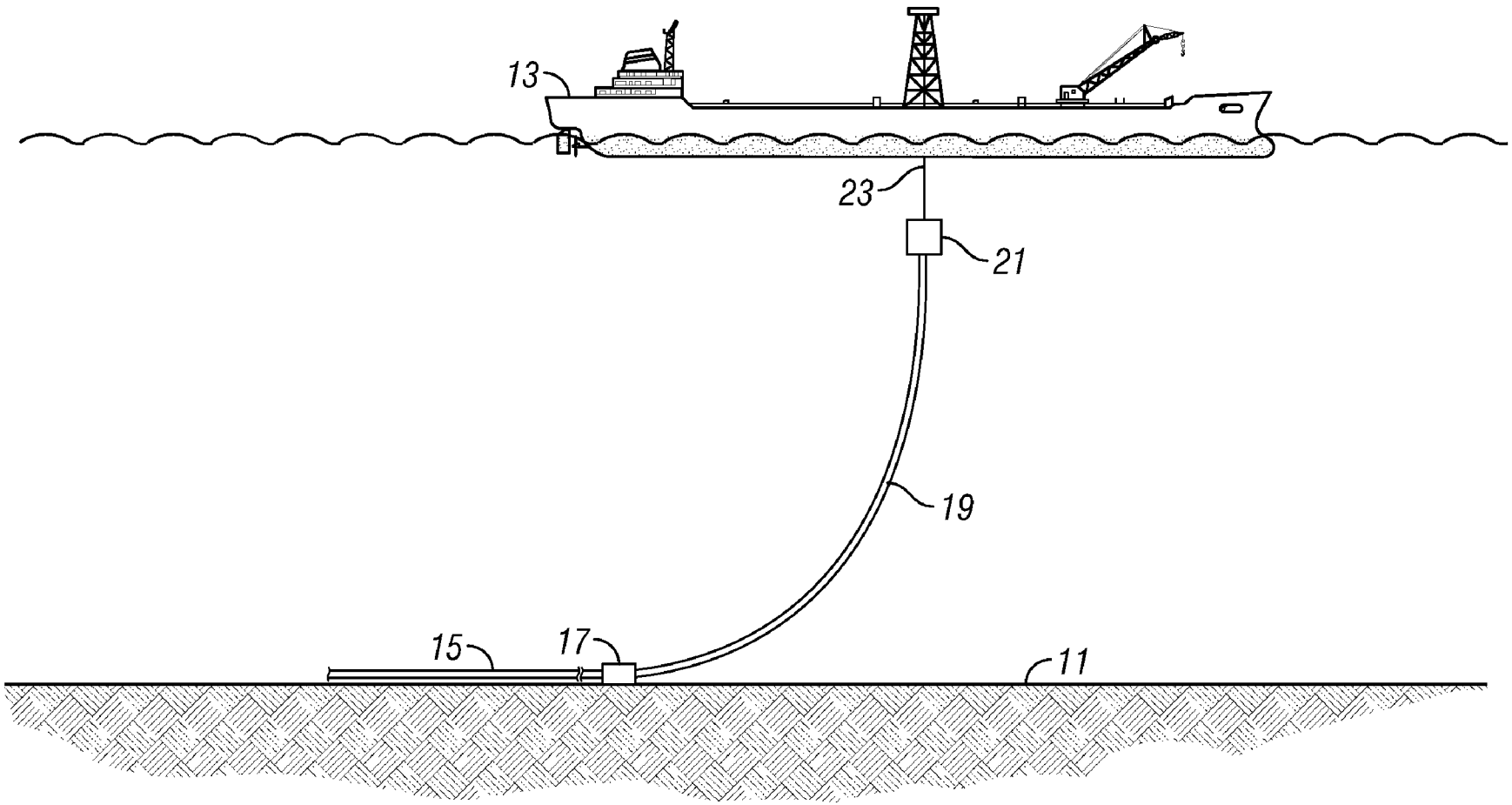
Figure 1D:
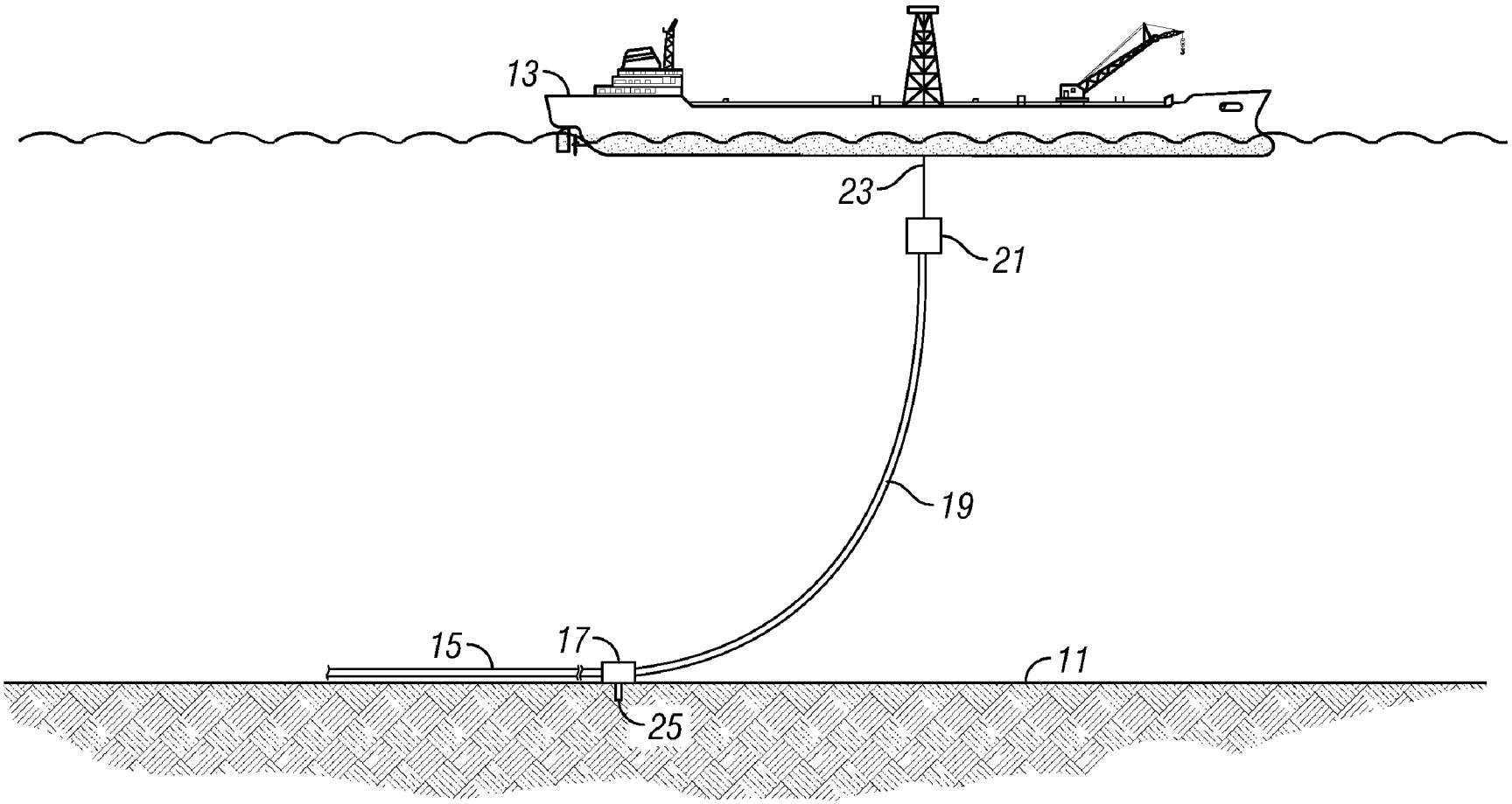
Figure 1E:
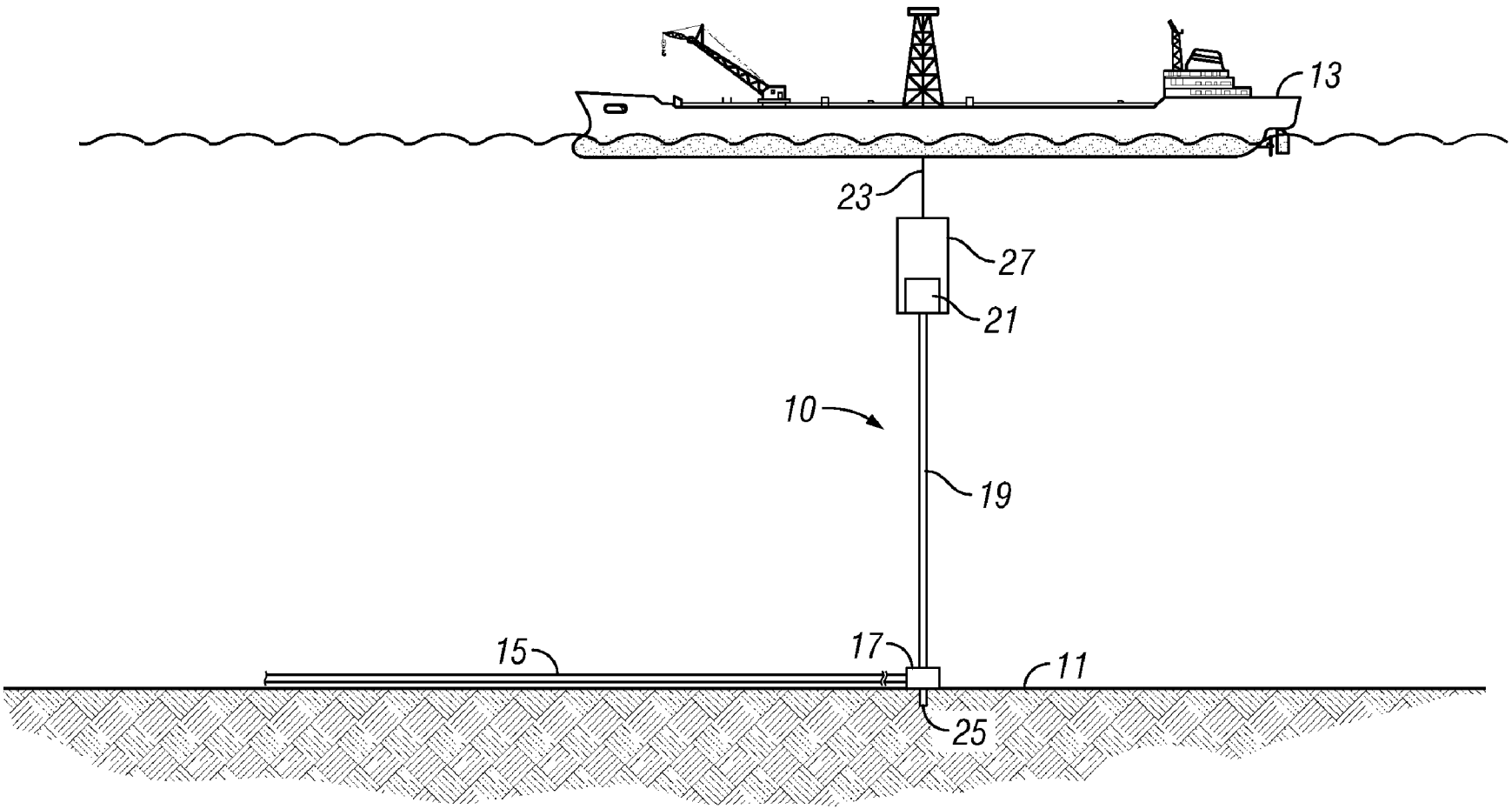
Figure 2:
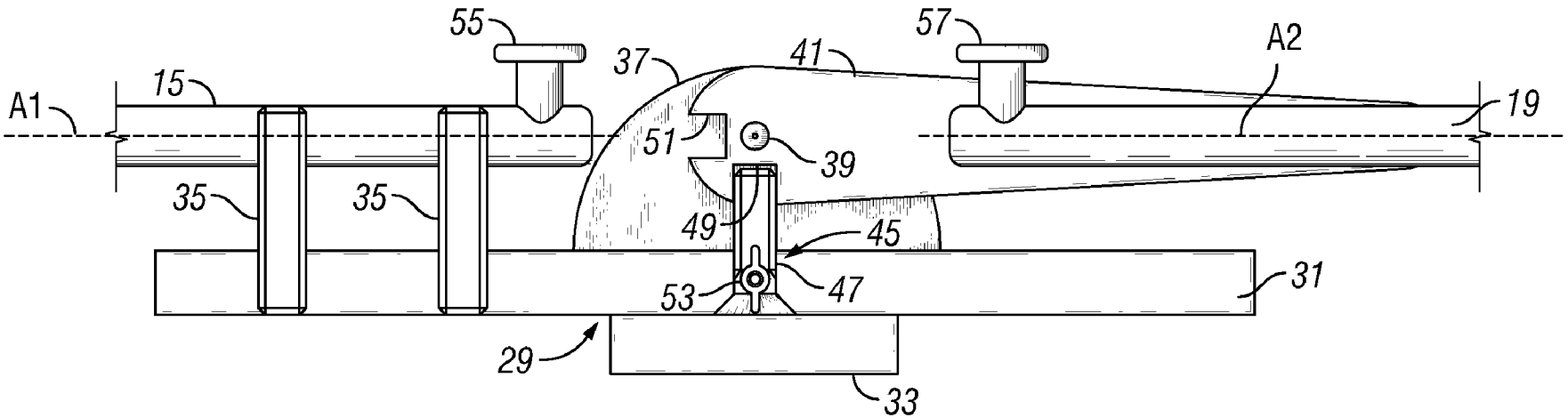
FIG. 2 is a schematic vertical view of the hinge-over joint portion of the subsea flowline and riser assembly of FIGS. 1A-1E, that is locked in an installation position.

As perhaps best shown in FIGS. 1B-1C, hinge-over joint 17 and riser 19 are then lowered from the vessel. As before with the segments of flowline 15, a plurality of segments of riser 19 are welded to previous segments in order to form riser 19. In the preferred embodiment, each riser segment is tubular steel. In the preferred embodiment, the last segment of riser 19 is attached such that riser 19 is a predetermined depth below the surface of the sea when riser 19 is installed. A buoy connection interface 21 is connected, typically through welding, to a second end or second end portion of riser 19 before the final riser segment is lowered into the sea. As best shown in FIG. 1C, after interface 21 is connected to riser 19, hinge-over joint 17 and riser 19 are lowered toward sea floor 11 with a wire line or cable 23. As hinge-over joint 17 and riser 19 are being lowered to sea floor 11, hinge-over joint 17 is in a deployment or installation position, which is illustrated in FIG. 2 and is described in more detail herein.

Hinge-over joint 17 and riser 19 are lowered into the sea from vessel 13 until hinge-over joint 17 reaches sea floor 11. Hinge-over joint 17 is then connected to a riser base, riser foundation pile or foundation 25. Foundation 25 is preferably a conventional foundation, such as a "suction pile" as is readily known to those skilled in the art, with interface for vertical riser connection at the top of the pile. However, foundation 25 should not be so limited to exclude unconventional foundations, riser bases, riser foundation piles, so long as they help to anchor the riser to sea floor 11. In the embodiment illustrated in FIGS. 1A-1E, foundation 25 is installed after hinge-over riser is lowered to sea floor 11. Typically, riser foundation 25 is installed with another vessel (not shown). Hinge-over joint 17 preferably remains in the installation position until hinge-over joint 17 is connected to foundation 25.

After hinge-over joint 17 is connected to foundation 25, riser 19 is rotated about hinge-over joint 17. In the preferred embodiment, riser 19 is rotated by sailing vessel 13 in the opposite direction from the direction vessel 13 sailed when lowering flowline 15, hinge-over joint 17, and riser 19. By sailing in the opposition direction, vessel 19 effectively pulls the second end portion of riser 19 upward from sea floor 11 and hinge-over joint 17, thereby causing riser 19 to rotate about hinge-over joint 17. Riser 19 is preferably rotated in such a manner until riser 19 is extending substantially perpendicular to sea floor 11, thereby defining an operational or operating position of hinge-over joint 17, which is illustrated in FIG. 4 and is described in more detail herein.

Hinge-over joint 17 is then locked in the operational position. After locking hinge-over joint 17 in the operational position, a buoy 27 is connected to buoy connection interface 21. Buoy 27 provides upward lift on riser 19 so that riser 19 remains substantially vertical relative to sea floor 11. A subsea jumper 59 (FIG. 4) is installed with a remote operated vehicle (ROV). In the preferred embodiment, buoy 27 is a subsurface buoy, having an upper surface that is at a depth such that a vessel sailing over buoy 27 does not collide with buoy 27. For example, buoy 27 can have its upper surface at a depth of fifty (50) meters. Buoy 27 preferably includes a mooring assembly and surface jumper for a floating production, storage and offloading (FPSO) vessel to moor and receive hydrocarbons from subsea flowline and riser assembly 10. Subsea flowline and riser assembly 10 can then be hydrotested and pre-commissioned in the usual manner prior to actuating valves to allow the hydrocarbons to communicate through the flowline, the subsea jumper, the riser, and the flexible jumper, to the FPSO.

The subsea jumper can be a separate component, which is pre-designed, manufactured and tested to be further integrated by an ROV to the hinge-over joint connection points. The subsea jumper can also be a subcomponent part of the hinge-over device, which is activated by ROV to latch on to a final operation position and allow fluid continuity from flowline and riser.

Figure 3:
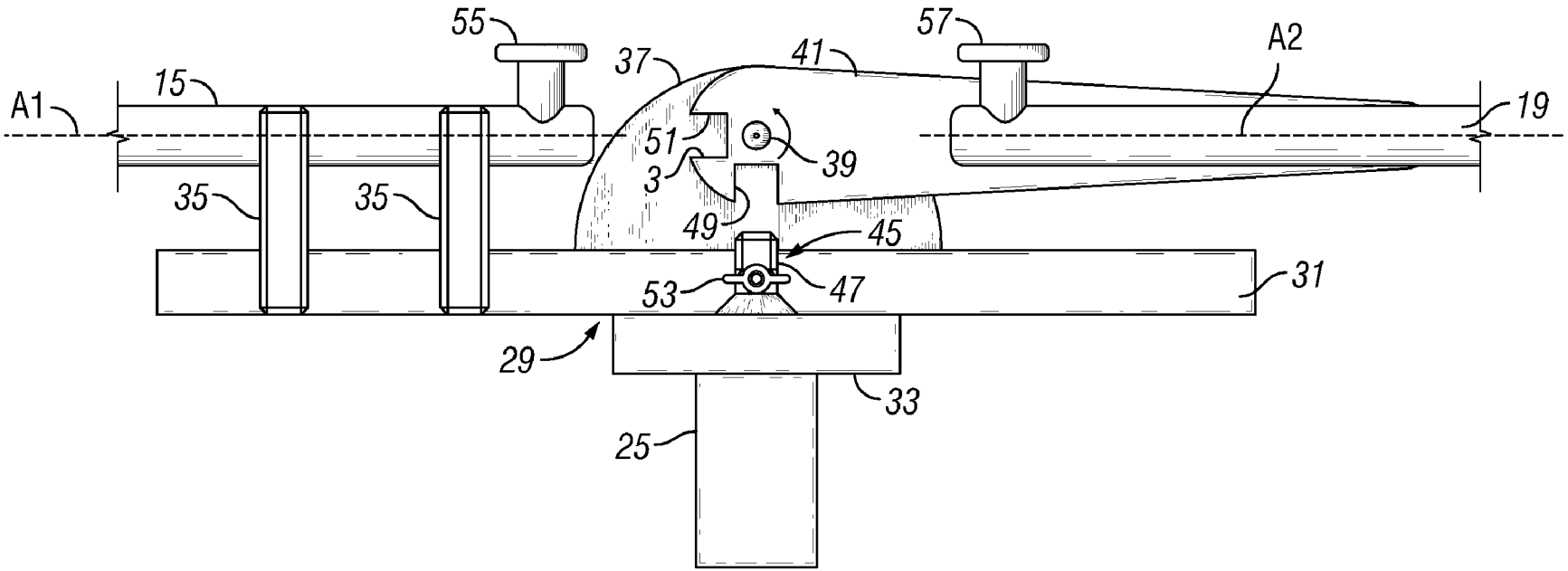
FIG. 3 is a schematic vertical view of the hinge-over joint portion of the subsea flowline and riser assembly of FIG. 2 that is unlocked, and in a hinge-over position.
Figure 4:
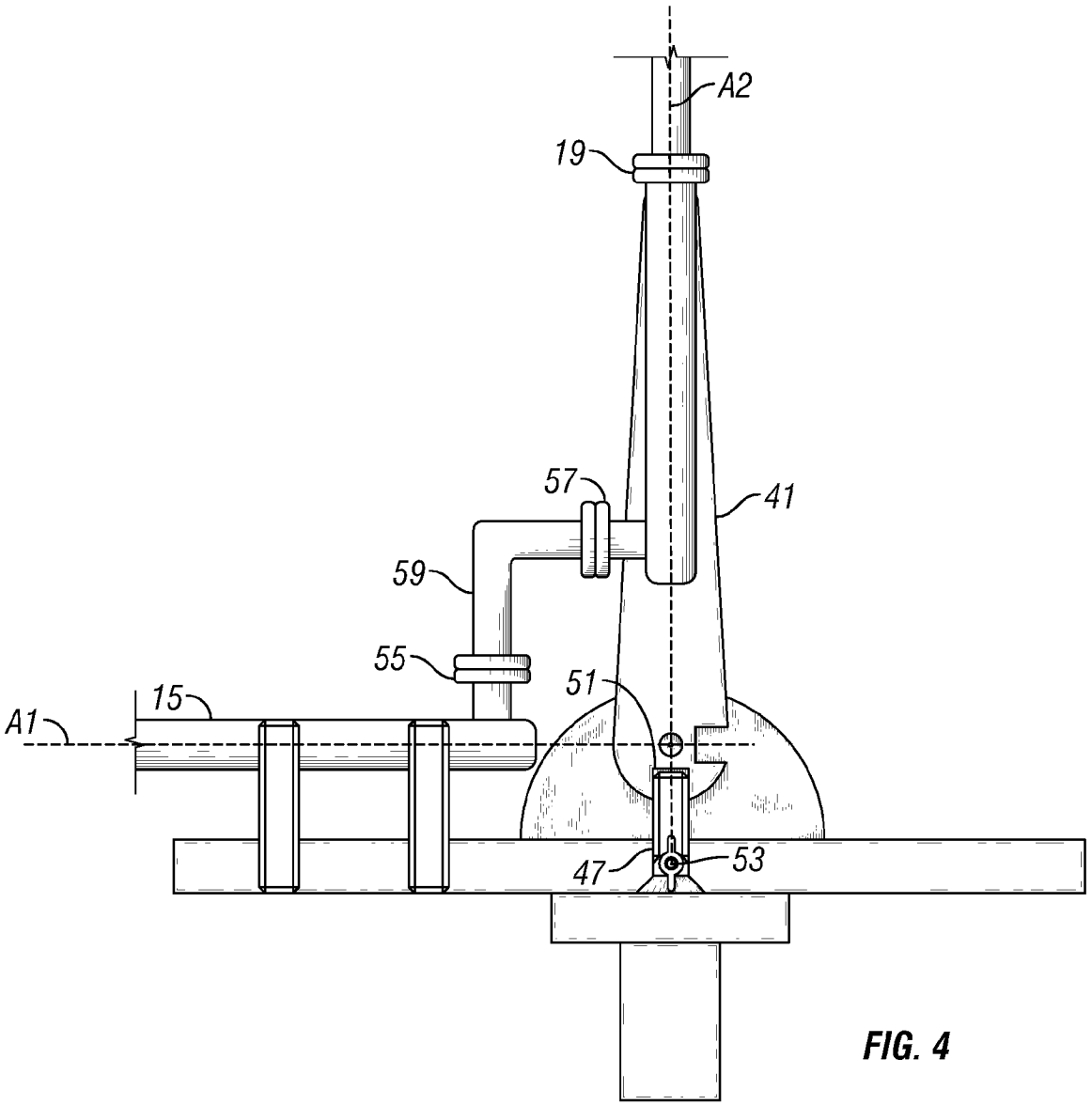
FIG. 4 is a schematic vertical view of the hinge-over joint portion of the subsea flowline and riser assembly of FIG. 2 that is locked in an operational position.

Referring to FIGS. 2-4, hinge-over joint 17 includes a base assembly or base 29. Base preferably includes a support member 31 and a foundation interface 33. Support member 31 typically extends substantially parallel with sea floor 11 when installed on foundation 25. In the preferred embodiment, support member 31 is substantially parallel with an axis A1 of flowline 15. When hinge-over joint 17 is in the installation or deployment position (FIG. 2), axis A1 of flowline 15 is substantially parallel with an axis A2 of riser 19. When hinge-over joint 17 is in the installation or deployment position (FIG. 2), axis A1 of flowline 15 is preferably in-line or coaxial with axis A2 of riser 19. When hinge-over joint 17 is in the operating position (FIG. 4), axis A2 of riser 19, or at least axis A2 extending from the first end of riser 19, traverses or intersects axis A1 of flowline 15, or at least axis A1 extending from the second end of flowline 15. In the preferred embodiment, axis A2 of riser 19 or at least axis A2 extending from the first end of riser 19 is substantially perpendicular to axis A1 of flowline 15 or at least axis A1 extending from the second end of flowline 15.

Foundation interface 33 is the portion of base 29 that engages foundation 25 when hinge-over joint 17 connects to foundation 25, as shown in FIG. 3. Base 29 also preferably includes a trunion base 37 connected to a surface support member 31 opposite from foundation interface 33. A hinge pin 39 extends from trunion base 37. An arm 41 is pivotally mounted to base 29 with hinge pin 39. As arm 41 rotates between the installation position shown in FIG. 2 to the operating position shown in FIG. 4, a lower portion of arm 41 pivots about hinge pin 39. In the preferred embodiment, the first end of riser 19 is connected to arm 41 so that movement of the arm 41 corresponds with movement of riser 19, and movement of the first end of riser 19 corresponds with movement of arm 41 about hinge pin 39.

A lock mechanism 45 secures arm 41 in the installation and operating positions of hinge-over joint 17. Lock mechanism 45 preferably includes a locking member 47 that selectively engages first and second lock receptacles 49,51. As shown in FIGS. 2 and 4, locking member 47 engages first lock receptacle 49 to hold arm 41 secure when hinge-over joint 17 is in the installation position. Locking member 47 engages second lock receptacle 51 when hinge-over joint 17 is in the operating position. In the preferred embodiment, locking member 47 selectively retracts from a locked position in engagement with either first or second receptacles 49,51, to an unlocked position shown in FIG. 3.

Locking member 47 can retract through simple displacement or through telescoping action of locking member 47. As will be readily appreciated by those skilled in the art, arm 41 is free to move between the installation position and the operating position when locking member 47 is unlocked and free of engagement with either first or second lock receptacles 49,51. In the preferred embodiment, an actuation handle 53 actuates locking member 47 between the locked and unlocked positions. Actuation handle 53 is adapted to be actuated with an ROV for selectively actuating locking member 47 between locked and unlocked positions.

A flowline opening connection or flowline opening 55 is formed adjacent second end portion of flowline 15. Flowline opening 55 is used for connecting a tubular structure or conduit in fluid communication with the interior of flowline 15. A riser opening 57 is formed adjacent first end portion of riser 19. Riser opening connection or riser opening 57 is in fluid communication with the interior of riser 19. In the preferred embodiment, flowline and riser openings 55,57 are separated by a known geometric distance when hinge-over joint 17 is in the operating position. In other words, the three-dimensional distance between flowline opening and riser opening 55,57 for when hinge-over joint 17 is in the operating position is already known and measured.

After connecting hinge-over joint 17 to foundation 25 and locking arm 41 in the operating position, a subsea jumper 59 is installed between flowline opening 55 and riser opening 57. Subsea jumper 59 is preferably a tubular structure, pre-fabricated to extend between and connected to flowline and riser openings 55,57. Typically, subsea jumper 59 is lowered to hinge-over joint 17 with a wireline and connected with an ROV. Alternatively, subsea jumper 59 can be connected to either one of flowline or riser openings 55,57 prior to hinge-over joint 19 being lowered to sea floor 11, and the ROV physically connects subsea jumper 59 to the other of flowline or riser openings 55,57. Further, subsea jumper 59 can also be connected to one of flowline or riser openings 55,57 and the ROV hydraulically actuates the subsea jumper into connection with the other of flowline or riser openings 55,57. For example, subsea jumper 59 can be a built in hydraulic activated telescoping system that retracts to disengage or extend to engage subsea jumper 59 for attainment of fluid continuity between the interior of flowline 15 and interior of riser 19. In either arrangement, connecting flowline and riser openings 55,57 is quicker and easier because subsea jumper 59 is pre-fabricated to extend a known distance, in a known direction in order to connect flowline 15 and riser 19 in fluid communication.

Figure 5A:
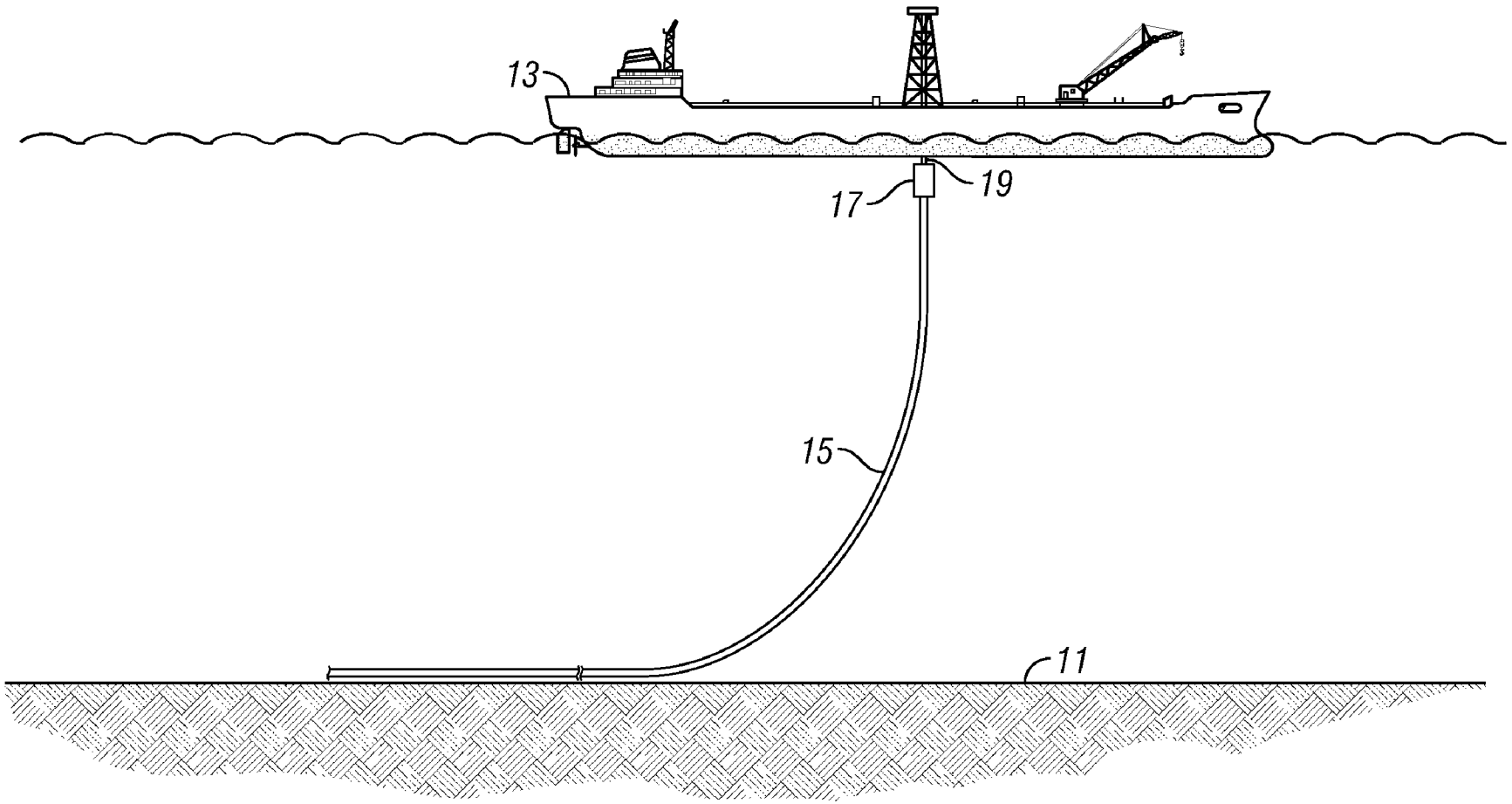
FIGS. 5A-5F are sequential, schematic views of a subsea flowline and riser assembly constructed and being installed in accordance with another embodiment of this invention.
Figure 5B:
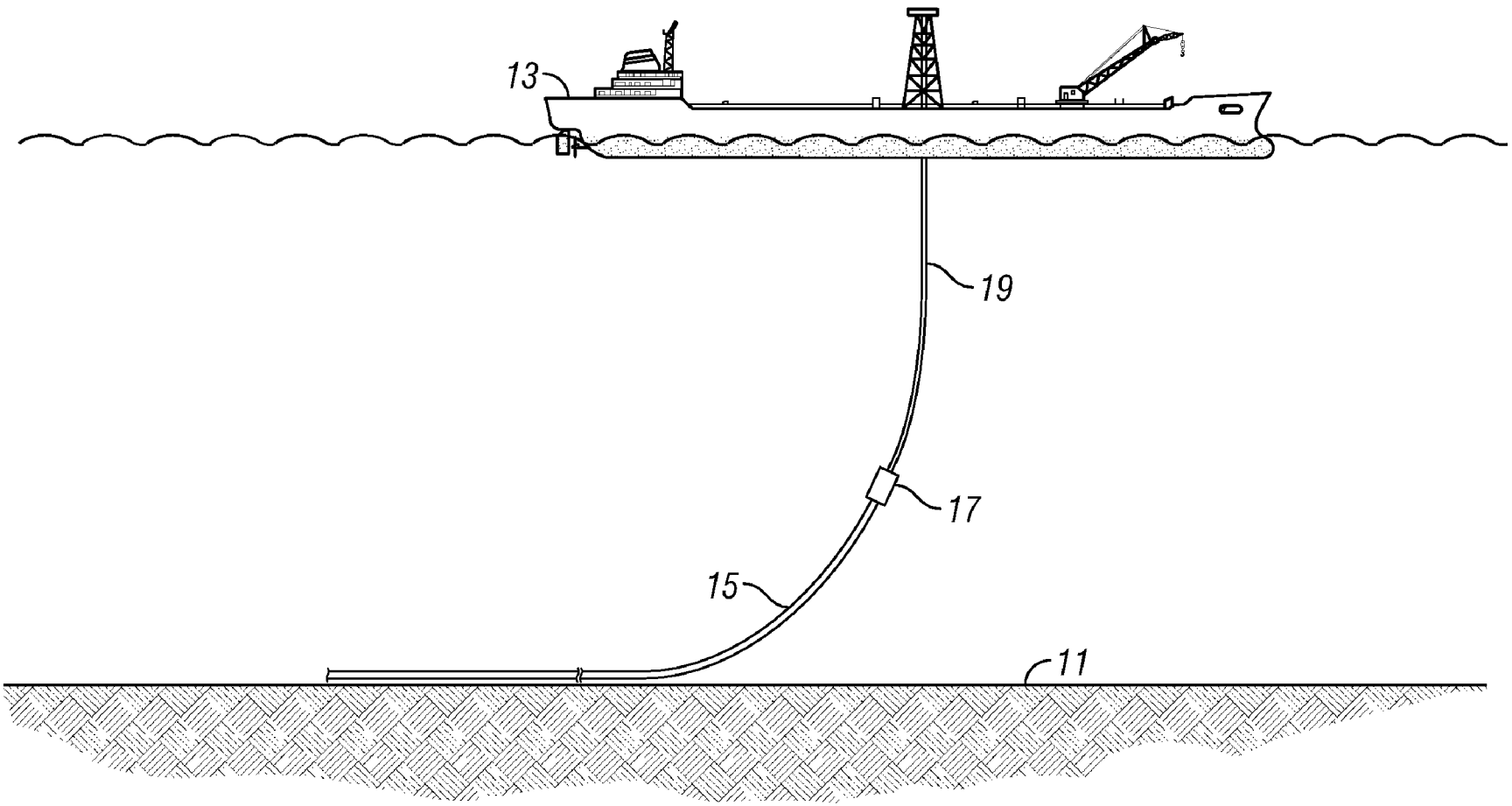
Figure 5C:
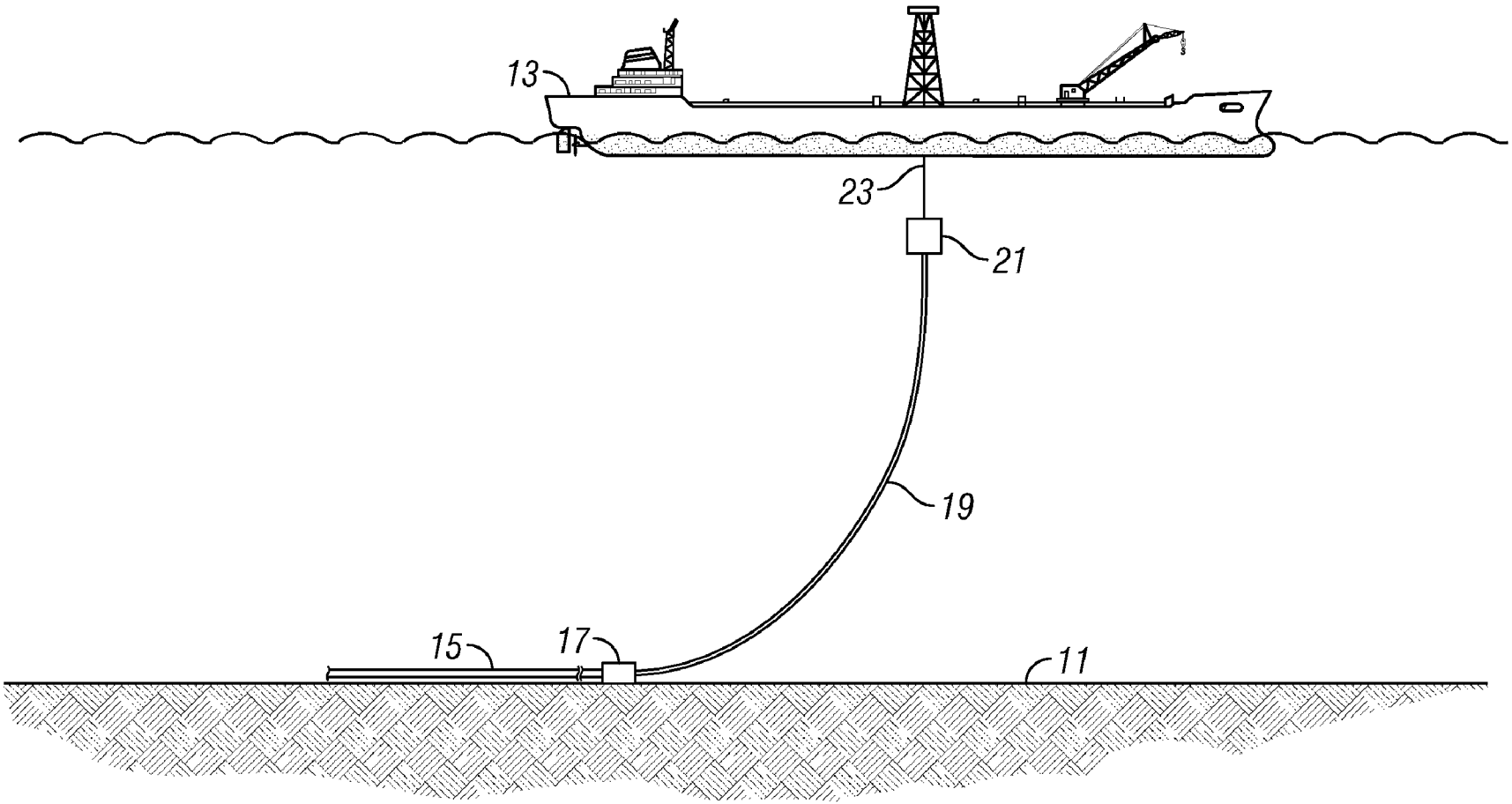
Figure 5D:
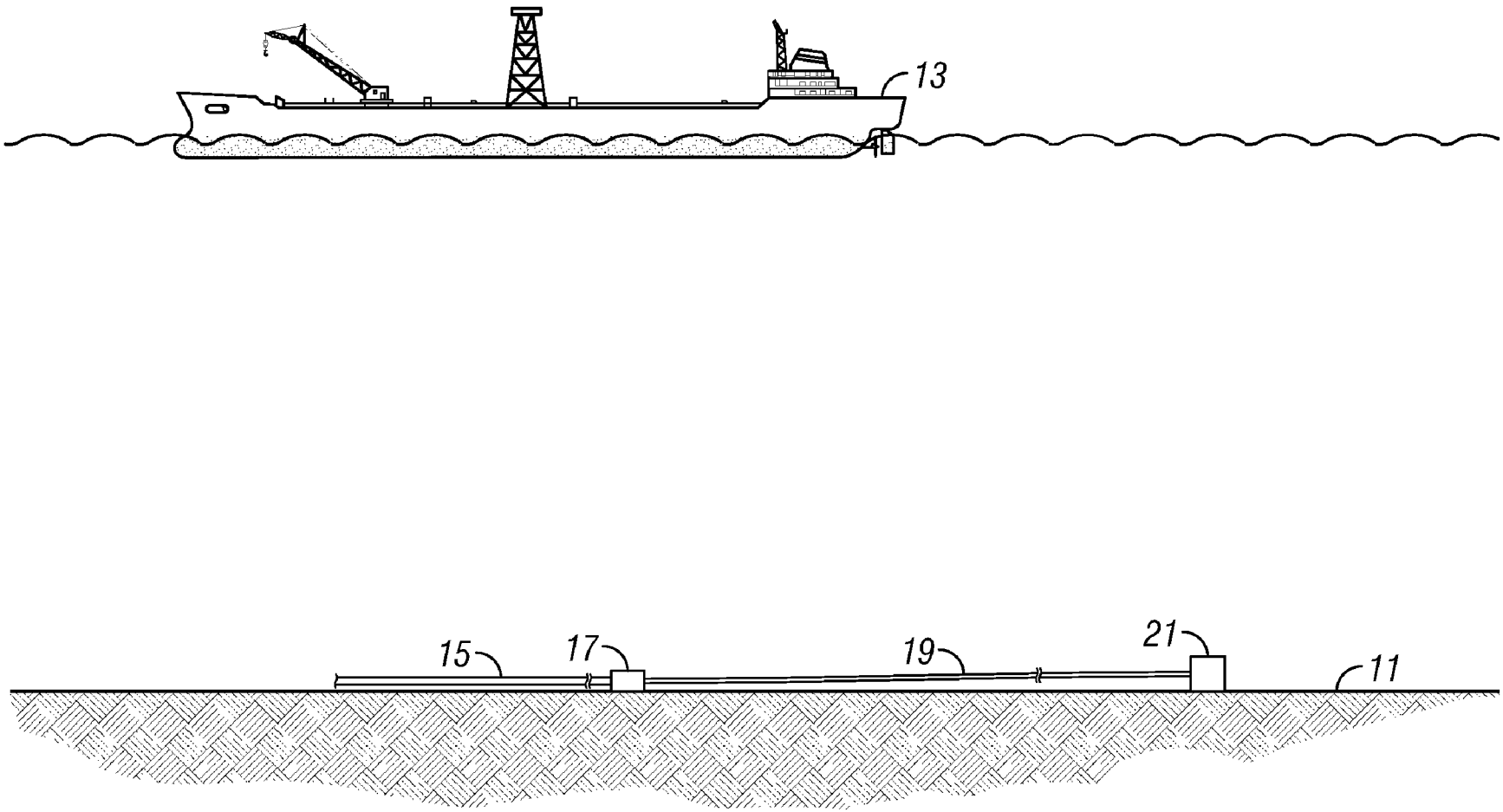
Figure 5E:
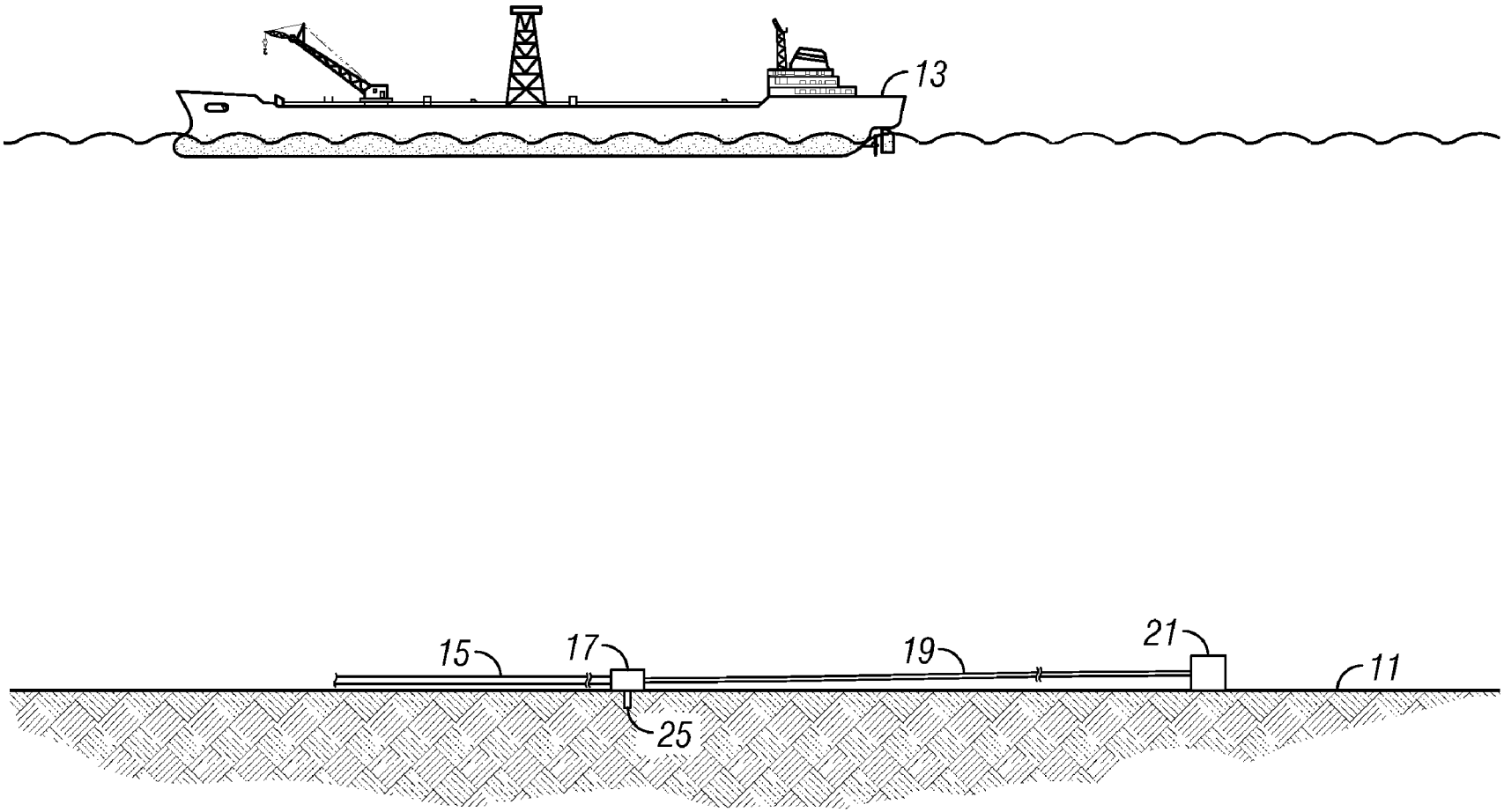
Figure 5F:
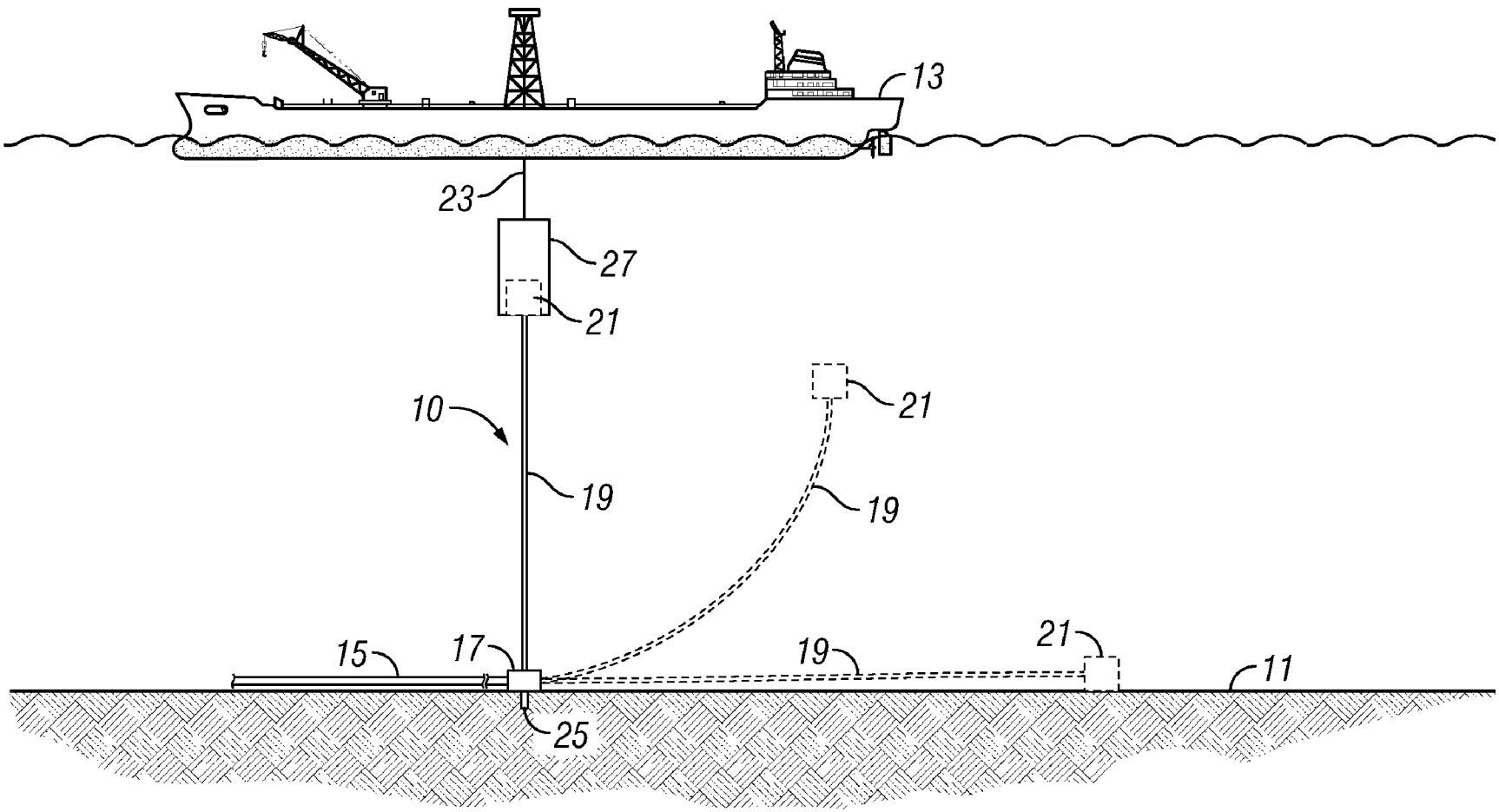
Figure 6A:
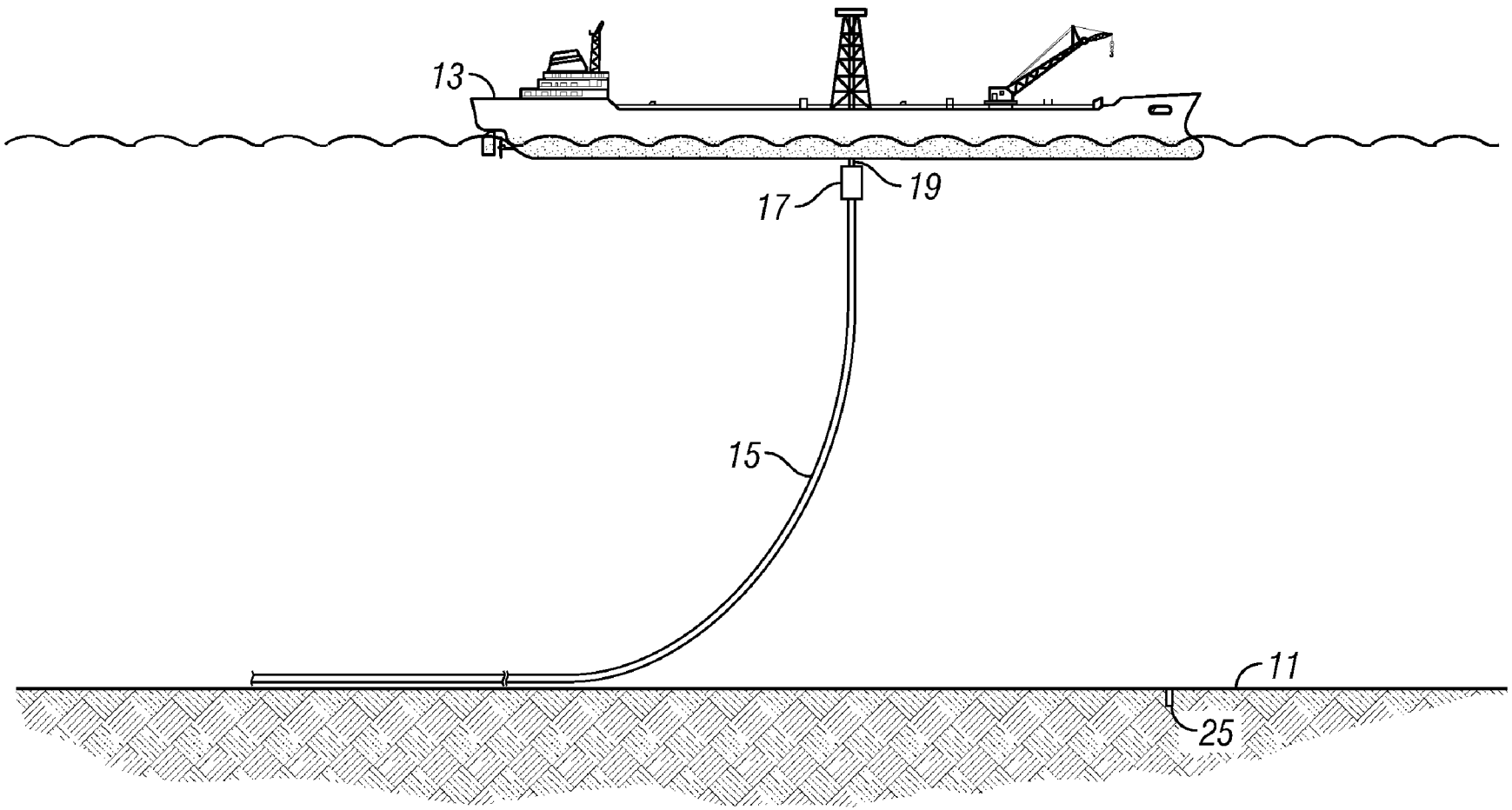
FIGS. 6A-6D are sequential, schematic views of a subsea flowline and riser assembly constructed and being installed in accordance with another embodiment of this invention.
Figure 6B:
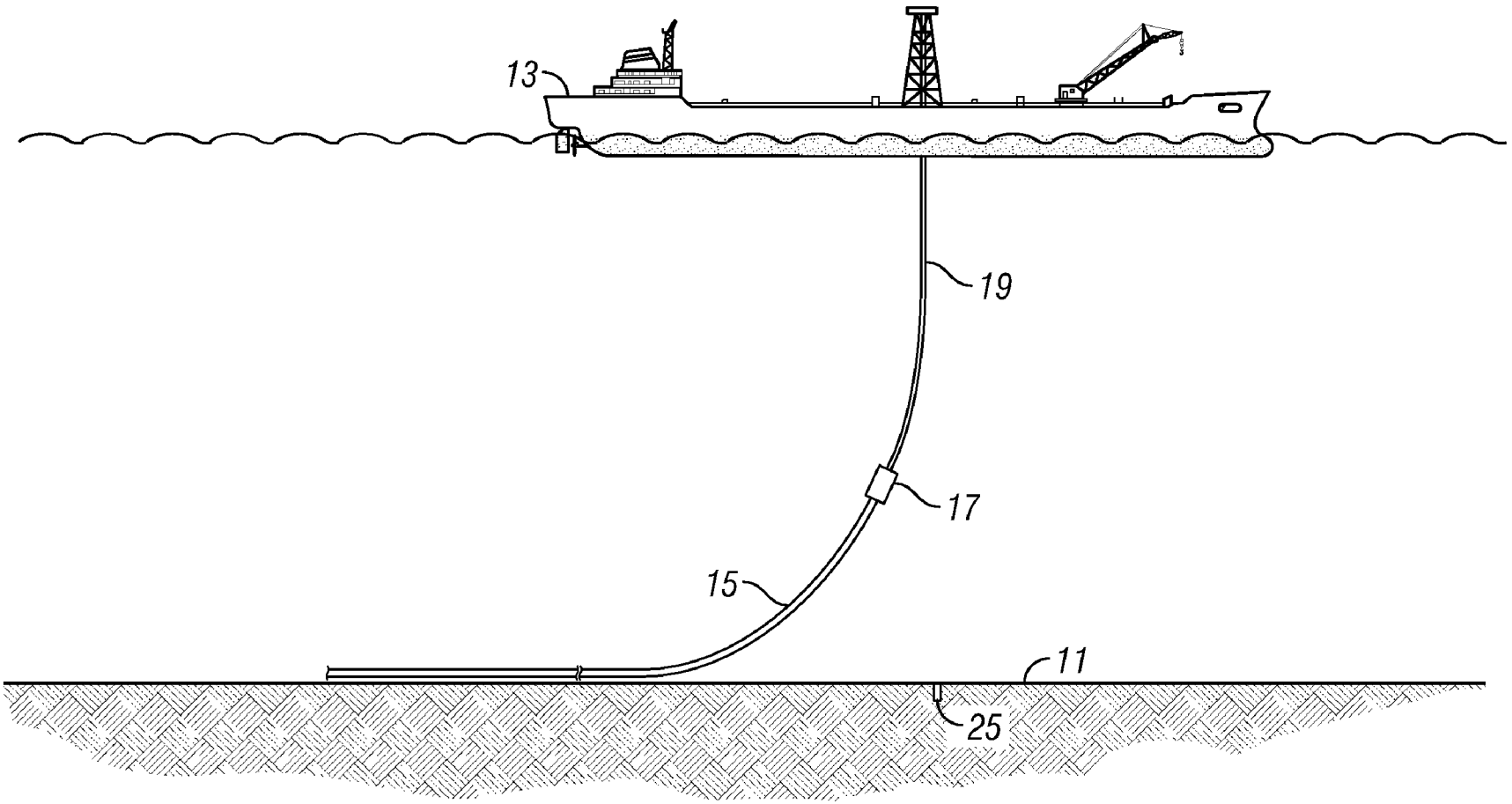
Figure 6C:
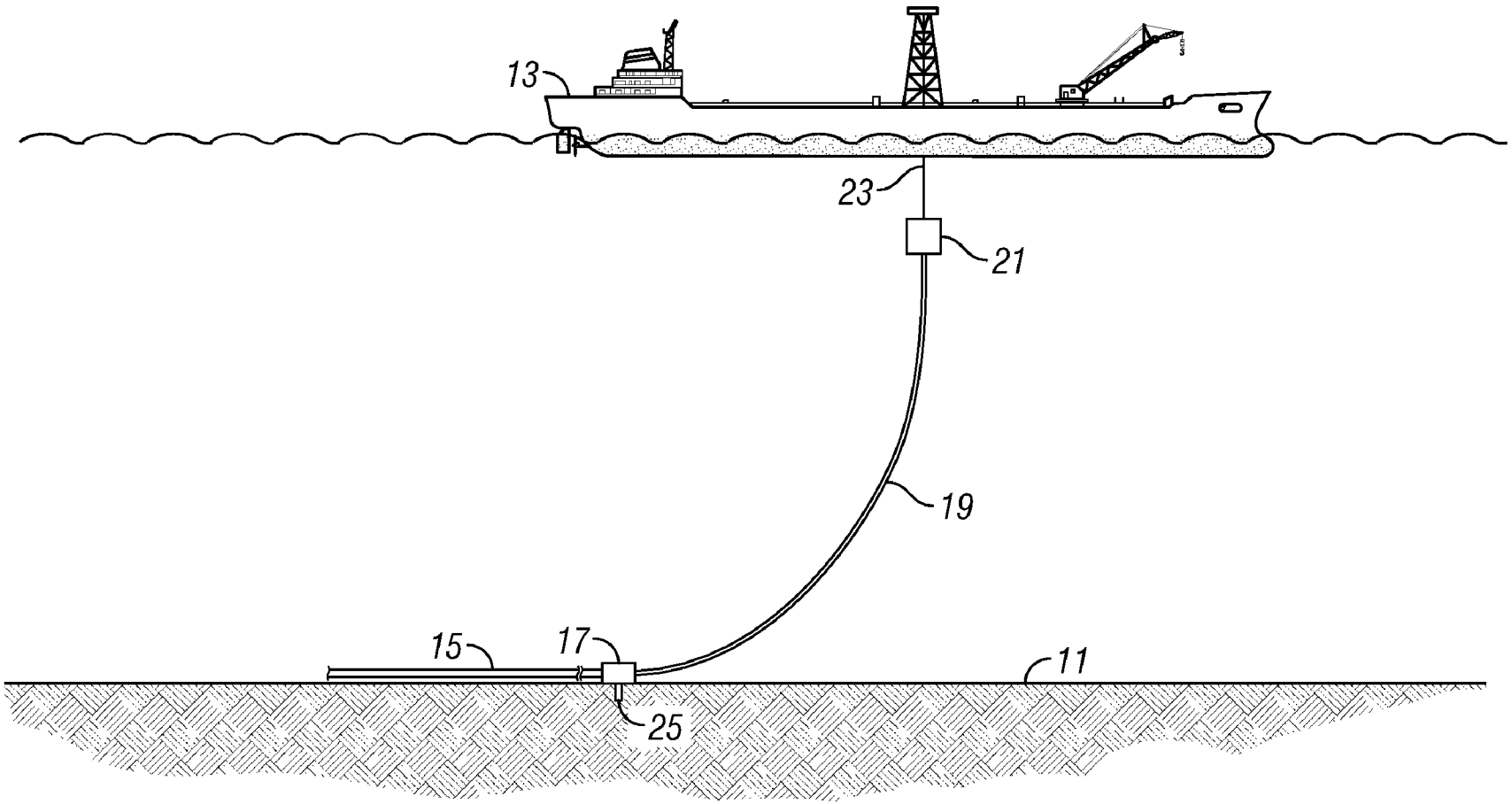
Figure 6D:
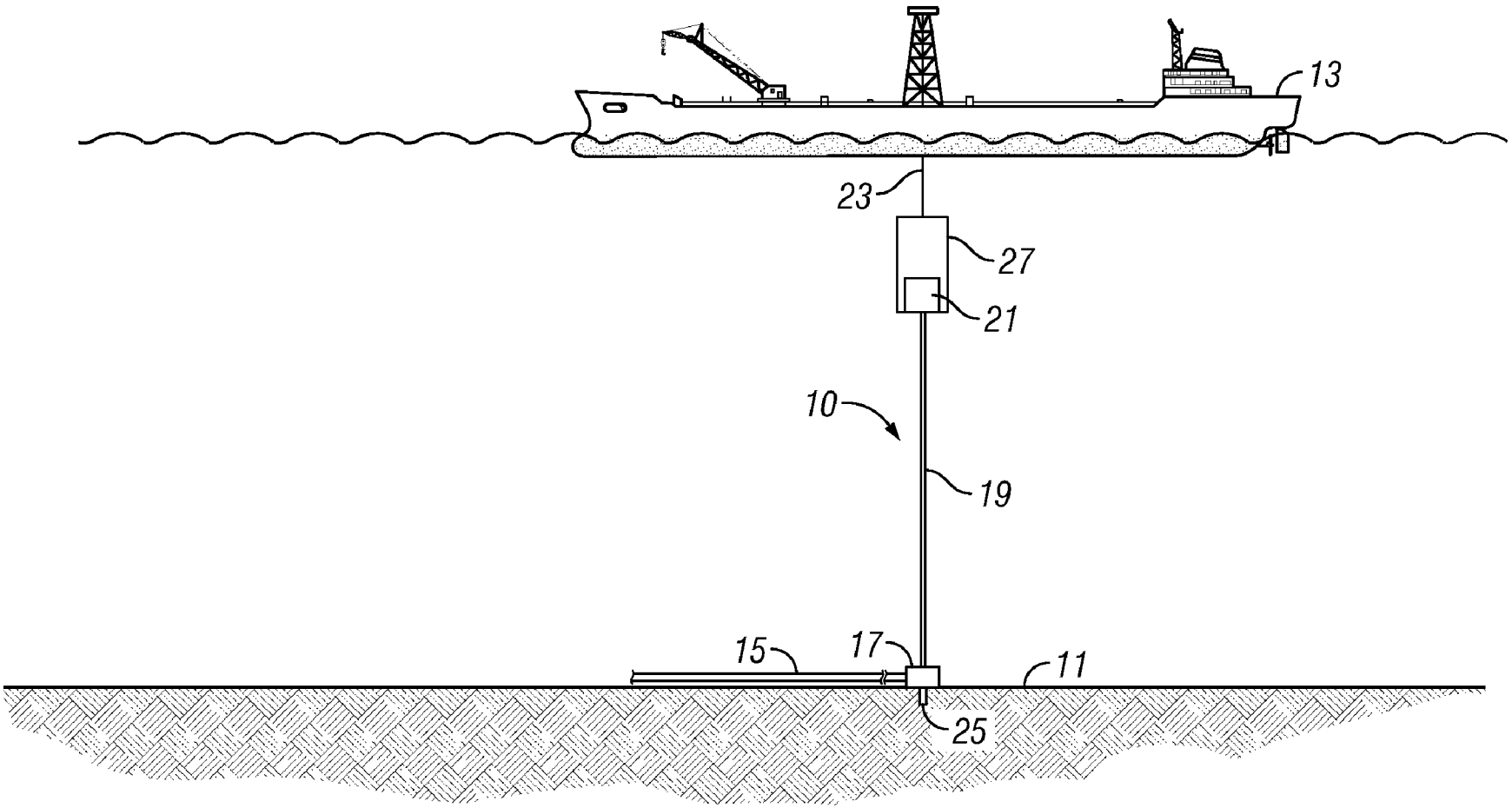

Referring to FIGS. 5A-5F, in an alternative embodiment of the method for installing flowline and riser assembly 10, vessel 13 lowers flowline 15, hinge-over joint 17, and riser 19 to sea floor 11 in substantially the same manner as that shown in FIGS. 1A-1C until hinge-over joint 17 reaches sea floor 11. As shown in FIG. 5D, in this alternate method, vessel 13 continued lowering riser 19 until the second end of riser 19 is also at sea floor 11. As shown in FIG. 5E, another vessel arrives, or vessel 13 sails into position, and installs foundation 25. Hinge-over joint 17 is then connected to foundation 25. When the floating production unit is installed and on position, the riser installation can be resumed. Then the lock mechanism 45 is unlocked so that arm 41 can rotate, and vessel 13 rotates riser 19, as shown in FIG. 5F, about hinge-over joint 17 to the operating position. As is perhaps best illustrated in FIG. 5F, vessel 13 rotates riser 19 about hinge-over joint 17 by lifting second end of riser 19 with wireline 23.

After riser 19 and hinge-over joint 17 are in the operating position, lock mechanism 45 is actuated to the locked position with locking member 47 engaging second lock receptacle 51. Subsea jumper 59 and buoy 27 are then installed in the same manner as described for the first embodiment. This embodiment is useful because it allows the flowline and riser installation vessel to go elsewhere and lay other flowline and riser assemblies while waiting for a vessel to install foundation 25.

Referring to FIGS. 6A-6D, according to another embodiment of the method of installing flowline and riser assembly 10, foundation 25 can be installed prior to lowering hinge-over joint 17. Foundation 25 can be installed with vessel 13 or with another vessel prior to vessel 13 arriving to lower pipeline 15, hinge-over joint 17, and riser 19 to sea floor 11. As with the prior method, this method allows the operator more flexibility with respect to the use of such various vessels, so that one vessel does not necessarily have to wait on another before beginning the installation process. However, as will readily be appreciated by those skilled in the art, vessel 13 needs to be precise in where it lowers the first end of pipeline 15 so that hinge-over joint 17 lands substantially on foundation 25 rather than merely within the typically larger target area or target zone that is aimed for when the foundation is not previously installed.

Figure 7A:
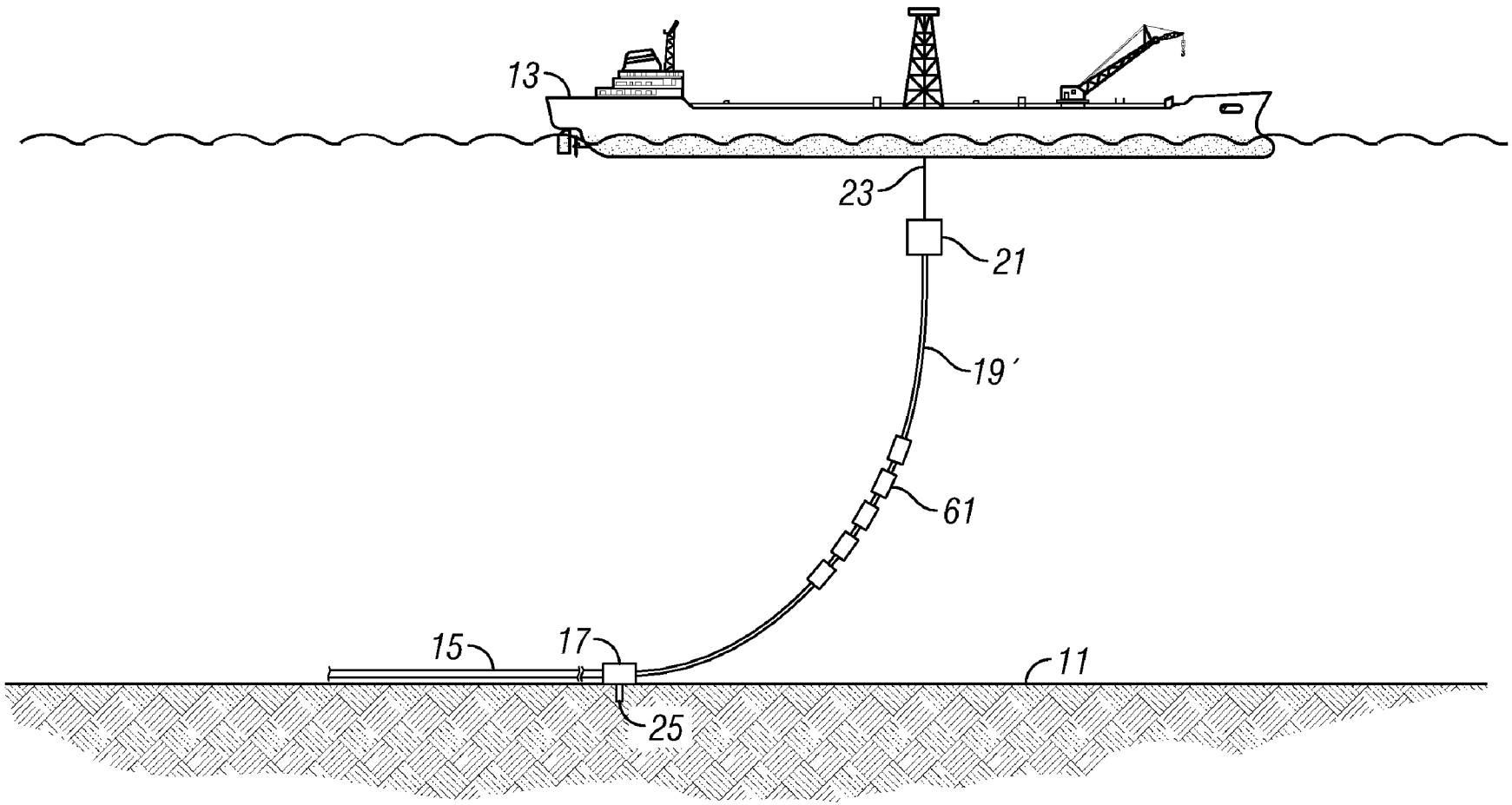
FIGS. 7A-7C are sequential, schematic views of a subsea flowline and riser assembly constructed and being installed in accordance with another embodiment of this invention.
Figure 7B:
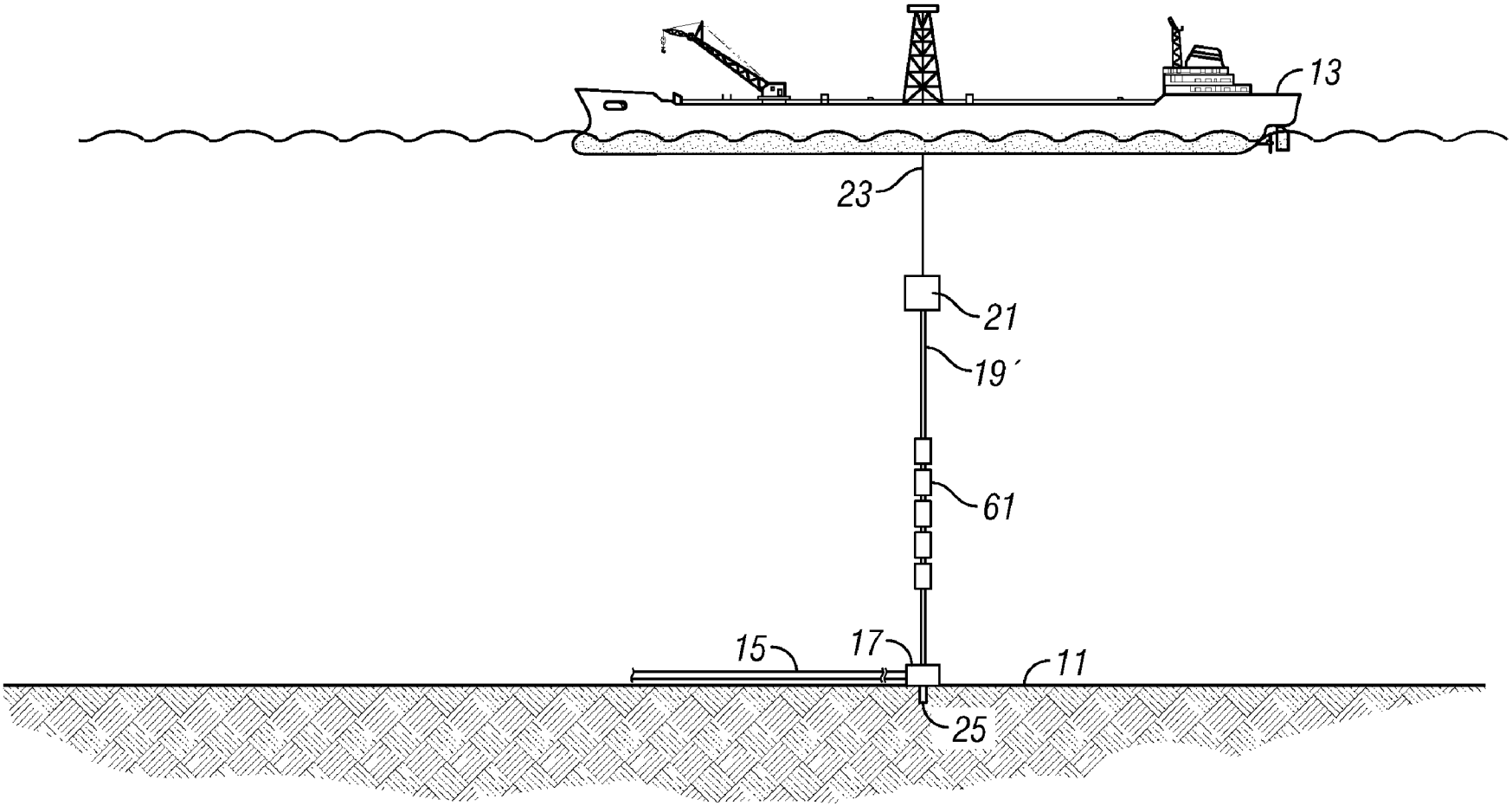
Figure 7C:
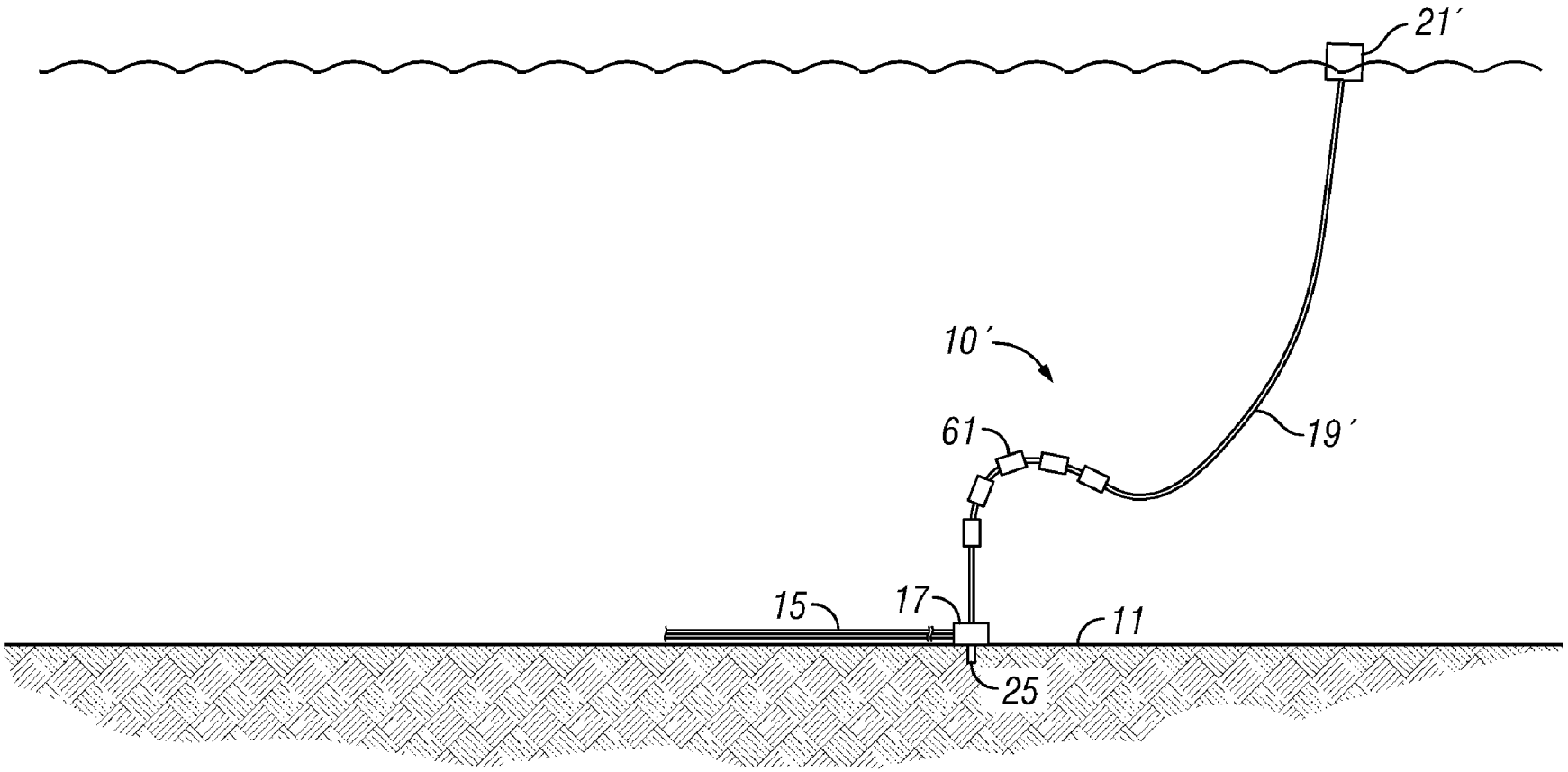

Referring to FIGS. 7A-7C, according to another embodiment of the method of installing a flowline and riser assembly 10', riser 19' is equipped with a plurality of subsea buoys 61 to form a "steep wave" riser as part of flowline and riser assembly 10' (FIG. 7C). Connection 21' is also preferably utilized for a direction connection with the floating production unit. As shown in FIGS. 7A and 7B, flowline 15, hinge-over joint 17 and riser 19' are preferably lowered to sea floor 11 in substantially the same manner as before. Hinge-over joint 17 is unlocked after being connected to foundation 25 and riser 19' is rotated about joint 17 to a substantially vertical position. In this position, riser axis A2, or at least axis A2 extending from the first end of riser 19', is traversing and typically perpendicular to flowline axis A1, or at least axis A1 extending from the second end of flowline 15. Hinge-over joint 17 is then locked in the operating position with arm 41 extending substantially vertically upward relative to base 29.

The connection 21 at the upper end portion or second end portion of riser 19' is handed over and finally connected to the structure of the floating production unit. In this embodiment, riser 19' can be made of steel pipe or flexible pipe. Subsea buoys 61 form an arc-shaped curvature in riser 19' and help to keep the lowermost end portion of riser 19' substantially vertical relative to hinge-over joint 17.

While the invention has been shown in only some of its forms, it should be apparent to those skilled in the art that it is not so limited, but susceptible to various changes without departing from the scope of the invention. For example, foundation 25 can be installed adjacent a larger riser foundation, and after rotating riser 19 about hinge-over joint 17, riser 19 can be moved over to and connected with the larger riser foundation. Then a subsea jumper is connected between flowline opening 55 adjacent hinge-over joint 17 and riser opening 57, which is now adjacent the larger riser foundation upon which riser 19 is connected.

What is claimed is:

1. A method for installing a subsea flowline and riser assembly on a sea floor, comprising:

(a) providing a flow-line having a flowline axis and an end connected to a hinge-over joint, and a riser having a riser axis and an end connected to the hinge-over joint such that the axes of the riser and flowline extend substantially parallel to each other;

(b) lowering an end of the flowline located opposite from the hinge-over joint to the sea floor;

(c) lowering the end of the flowline being connected to the hinge-over joint to the sea floor;

(d) connecting the hinge-over joint to a foundation installed in the sea floor;

(e) rotating the riser about the hinge-over joint such that the riser axis is substantially perpendicular to the flowline axis; and (f) after the riser is rotated about the hinge-over joint such that the riser axis is substantially perpendicular to the flowline axis, connecting a subsea jumper between a flowline opening formed in the flowline and a riser opening formed in the rise that the riser is in fluid communication with the flowline.

2. The method according to claim 1, wherein step (e) further comprises lowering an end of the riser opposite from the end connected to the hinge-over joint to the seafloor and then the end of the riser opposite from the end connected to the hinge-over joint upward such that the riser is substantially vertical relative to the sea floor.

3. The method according to claim 1, wherein in step (a) the axes of the riser and flowline extend substantially coaxially.

4. The method according to claim 1, wherein prior to step (b) the foundation is installed in the sea floor.

5. The method according to claim 1, wherein the foundation is installed after step (c).

6. The method according to claim 1, wherein step (a) further comprises:

providing that the hinge-over joint comprises a movable arm and a joint base, the arm being pivotally connected to the base and the riser being connected to the arm; and locking the arm in a deployment position prior to step (b) so that the axes of the riser and flowline remain substantially parallel prior to step (e).

7. The method according to claim 6, wherein step (e) further comprises the step of unlocking the arm prior to rotating the riser about the hinge-over joint, and locking the arm in an operating position so that the axes of the riser and the flowline remain substantially perpendicular prior to step (f).

8. The method according to claim 7, further comprising operating a remote operated vehicle to unlock and lock the arm.

9. The method according to claim 1, wherein a remote operated vehicle connects the subsea jumper between the riser opening and the flowline opening in step (f).

10. A method for installing a subsea flowline and riser assembly on a sea floor, comprising:

(f) lowering a first end of a flowline from a floating vessel to the sea floor;

(g) connecting a hinge-over joint to a second end of the flowline;

(h) connecting a first end of a riser to the hinge-over joint, and lowering the hinge-over joint and first end of the riser to the sea floor from the vessel, the hinge-over joint aligning the flowline and the riser such that a flowline axis extending from the second end of the flowline is substantially in-line with a riser axis extending from the first end of the riser;

(i) connecting the hinge-over joint to a foundation installed in the sea floor;

(j) lifting a second end of the riser in order to rotate the riser about the hinge-over joint such that the riser axis extending from the first end of the riser traverses the flowline axis extending from the flowline; and (k) with a remote operated vehicle, connecting a subsea jumper between a flowline opening formed adjacent the second end of the flowline and a riser opening formed adjacent the first end of the riser so that the riser is in fluid communication with the flowline.

11. The method according to claim 10, further comprising fabricating the subsea jumper prior to step (a) pursuant to predetermined dimensions such that the subsea jumper readily connects between the flowline opening and the riser opening following step (e).

12. The method according to claim 10, wherein:

step (b) further comprises providing that the hinge-over joint comprises a movable arm and a joint base, and the second end of the flowline being connected to the base; and in step (c) the arm being pivotally connected to the base and the first end of the riser being connected to the arm; and locking the arm in a deployment position prior to step (c) so that the flowline axis extending from the second end of the flowline and the riser axis extending from the first end of the riser remain substantially in-line when lowering the hinge-over joint and the first end of the riser.

13. The method according to claim 12, wherein step (e) further comprises the steps:

unlocking the arm prior to lifting the second end of the riser and thereby rotating the riser about the hinge-over joint; and locking the arm in an operating position with the riser axis extending from the first end of the riser traversing the flowline axis extending from the second end of the flowline prior to step (f).

14. The method according to claim 13, wherein the riser axis extending from the first end of the riser is substantially perpendicular with the flowline axis extending from the second end of the flowline when the arm is locked in the operating position.

15. The method according to claim 10, further comprising, prior to step (d) the second end of the riser is lowered to the sea floor, and step (d) further comprises installing the foundation.

16. The method according to claim 10, further comprising, prior to step (a), installing the foundation, arid in step (c) the hinge-over joint is lowered onto the foundation.

* * * * *

UNITED STATES PATENT AND TRADEMARK OFFICE

CERTIFICATE OF CORRECTION

PATENT NO. : 7,628,568 B2
APPLICATION NO. : 11/668050
DATED : December 8, 2009
INVENTOR(S) : Critsinelis It is certified that error appears in the above-identified patent and that said Letters Patent is hereby corrected as shown below:

Column 9
Line 37, "rise" should read --riser--;
Line 42, after "to the seafloor and then" insert --moving--.

Column 10
Line 64, "arid" should read --and--.

Signed and Sealed this

Ninth Day of February, 2010

David J. Kappos

David J. Kappos
*Director of the United States Patent and Trademark Office*